US011267248B2

(12) United States Patent
Komatsu et al.

(10) Patent No.: US 11,267,248 B2
(45) Date of Patent: Mar. 8, 2022

(54) RECORDING DEVICE AND MAINTENANCE METHOD FOR RECORDING DEVICE

(71) Applicant: SEIKO EPSON CORPORATION, Tokyo (JP)

(72) Inventors: Shinya Komatsu, Shiojiri (JP); Keiji Matsumoto, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/790,373

(22) Filed: Feb. 13, 2020

(65) Prior Publication Data

US 2020/0262205 A1 Aug. 20, 2020

(30) Foreign Application Priority Data

Feb. 15, 2019 (JP) ..... JP2019-025249

(51) Int. Cl.

| | |
|---|---|
| ***B41J 2/165*** | (2006.01) |
| ***B41J 2/18*** | (2006.01) |
| ***B41J 2/19*** | (2006.01) |
| ***B41J 2/175*** | (2006.01) |

(52) U.S. Cl.

CPC ..... *B41J 2/16532* (2013.01); *B41J 2/17563* (2013.01); *B41J 2/17596* (2013.01); *B41J 2/18* (2013.01); *B41J 2/19* (2013.01)

(58) Field of Classification Search

CPC ..... B41J 2/16532; B41J 2/18; B41J 2/17596; B41J 2/17563; B41J 2/19

See application file for complete search history.

(56) References Cited

U.S. PATENT DOCUMENTS

| | | | | |
|---|---|---|---|---|
| 2013/0083099 | A1 | 4/2013 | Anno | |
| 2014/0285587 | A1 * | 9/2014 | Kida | B41J 2/18 347/85 |
| 2014/0285596 | A1 | 9/2014 | Ando | |
| 2017/0313097 | A1 * | 11/2017 | Profaca | B41J 2/17596 |

FOREIGN PATENT DOCUMENTS

| | | | | |
|---|---|---|---|---|
| JP | 2005-059476 | | 3/2005 | |
| JP | 2006-015631 | | 1/2006 | |
| JP | 2013-071038 | | 4/2013 | |
| JP | 2014-180857 | | 9/2014 | |
| JP | 2014-208421 | | 11/2014 | |
| JP | 2015-000518 | | 1/2015 | |
| JP | 2017061091 | A * | 3/2017 | B41J 2/1652 |
| WO | WO-2017074314 | A1 * | 5/2017 | B41J 2/165 |

* cited by examiner

*Primary Examiner* — Julian D Huffman
(74) *Attorney, Agent, or Firm* — Workman Nydegger

(57) ABSTRACT

A recording device includes: an ink flow path that couples a liquid reservoir to the ejection head such that the ink stored in the liquid reservoir is supplied to the ejection head; a feeding pump exchangeably provided in the ink flow path and configured to feed the ink toward the ejection head; a deaerator provided in the ink flow path; a vacuum level adjustment mechanism configured to adjust a vacuum level in the deaerator; and a control portion that controls the vacuum level adjustment mechanism to adjust the vacuum level in the deaerator in accordance with a status of an operation to be executed.

13 Claims, 7 Drawing Sheets

FIG. 6

| OPERATION TO BE EXECUTED | REQUIRED AMOUNT OF OXYGEN DISSOLVED IN LIQUID | UPPER LIMIT VALUE AND LOWER LIMIT VALUE OF VACUUM LEVEL (ABSOLUTE PRESSURE) | |
|---|---|---|---|
| | | UPPER LIMIT VALUE | LOWER LIMIT VALUE |
| INK FILLING OPERATION | 3 ppm TO 10 ppm | 5 kPa (PUMP CAPABILITY MAXIMUM VALUE) | 25 kPa |
| HEAD CLEANING OPERATION | 3 ppm TO 10 ppm | 5 kPa (PUMP CAPABILITY MAXIMUM VALUE) | 25 kPa |
| RECORDING OPERATION | 3 ppm TO 10 ppm | 5 kPa (PUMP CAPABILITY MAXIMUM VALUE) | 25 kPa |
| STANDBY STATE | 16 ppm TO 20 ppm | 65 kPa | 75 kPa |

FIG. 7

| OPERATION TO BE EXECUTED | REQUIRED AMOUNT OF OXYGEN DISSOLVED IN LIQUID | UPPER LIMIT VALUE AND LOWER LIMIT VALUE OF VACUUM LEVEL (ABSOLUTE PRESSURE) | |
|---|---|---|---|
| | | UPPER LIMIT VALUE | LOWER LIMIT VALUE |
| INK FILLING OPERATION | 3 ppm TO 10 ppm | 5 kPa (PUMP CAPABILITY MAXIMUM VALUE) | 25 kPa |
| HEAD CLEANING OPERATION | 3 ppm TO 10 ppm | 5 kPa (PUMP CAPABILITY MAXIMUM VALUE) | 25 kPa |
| RECORDING OPERATION | 11 ppm TO 20 ppm | 26 kPa | 75 kPa |
| STANDBY STATE | 16 ppm TO 20 ppm | 65 kPa | 75 kPa |

FIG. 8

| OPERATION TO BE EXECUTED | REQUIRED AMOUNT OF OXYGEN DISSOLVED IN LIQUID | UPPER LIMIT VALUE AND LOWER LIMIT VALUE OF VACUUM LEVEL (ABSOLUTE PRESSURE) | |
|---|---|---|---|
| | | UPPER LIMIT VALUE | LOWER LIMIT VALUE |
| INK FILLING OPERATION | 3 ppm TO 10 ppm | 5 kPa (PUMP CAPABILITY MAXIMUM VALUE) | 25 kPa |
| HEAD CLEANING OPERATION | 3 ppm TO 10 ppm | 5 kPa (PUMP CAPABILITY MAXIMUM VALUE) | 25 kPa |
| RECORDING OPERATION | 6 ppm TO 20 ppm | 15 kPa | 75 kPa |
| STANDBY STATE | 16 ppm TO 20 ppm | 65 kPa | 75 kPa |

FIG. 9

| OPERATION TO BE EXECUTED | REQUIRED AMOUNT OF OXYGEN DISSOLVED IN LIQUID | UPPER LIMIT VALUE AND LOWER LIMIT VALUE OF VACUUM LEVEL (ABSOLUTE PRESSURE) | |
|---|---|---|---|
| | | UPPER LIMIT VALUE | LOWER LIMIT VALUE |
| INK FILLING OPERATION | 3 ppm TO 10 ppm | 5 kPa (PUMP CAPABILITY MAXIMUM VALUE) | 25 kPa |
| HEAD CLEANING OPERATION | 11 ppm TO 20 ppm | 26 kPa | 75 kPa |
| RECORDING OPERATION | 11 ppm TO 20 ppm | 26 kPa | 75 kPa |
| STANDBY STATE | 11 ppm TO 20 ppm | 26 kPa | 75 kPa |

RECORDING DEVICE AND MAINTENANCE METHOD FOR RECORDING DEVICE

The present application is based on, and claims priority from JP Application Serial Number 2019-025249, filed Feb. 15, 2019, the disclosure of which is hereby incorporated by reference herein in its entirety.

BACKGROUND

1. Technical Field

The present disclosure relates to a recording device such as an ink jet printer, for example, and a maintenance method for a recording device.

2. Related Art

JP-A-2005-59476 describes, as an example of a recording device, an ink jet printer provided with an ejection head that ejects ink and a deaerator for removing air from the ink at a midpoint of an ink flow path. In such a case, a vacuum pump is coupled to the deaerator, and the vacuum pump serves to reduce the pressure in the deaerator to a negative pressure.

In such a recording device, a vacuum level (negative pressure level) in the deaerator is a vacuum level based on a specification (capability) of a vacuum pump and the vacuum level is not controlled. Therefore, ejection from the ejection head may become unstable due to the amount of gas dissolved in the ink.

SUMMARY

According to an aspect of the present disclosure, there is provided a recording device including: an ejection head configured to perform recording by ejecting ink onto a recording medium; an ink flow path that couples a liquid reservoir to the ejection head such that the ink stored in the liquid reservoir is supplied to the ejection head; a feeding pump exchangeably provided in the ink flow path and configured to feed the ink toward the ejection head; a deaerator provided in the ink flow path; a vacuum level adjustment mechanism configured to adjust a vacuum level in the deaerator; and a control portion that adjusts the vacuum level in the deaerator in accordance with a status of an operation to be executed.

According to another aspect of the present disclosure, there is provided a maintenance method for a recording device that includes an ejection head configured to perform recording by ejecting ink onto a recording medium, an ink flow path coupled to the ejection head such that the ink is supplied to the ejection head, a feeding pump exchangeably provided in the ink flow path and configured to cause the ink to flow toward the ejection head, and a deaerator provided in the ink flow path, the method comprising: performing adjustment such that a vacuum level in the deaerator when the ejection head is filled with the ink is higher than the vacuum level in the deaerator when the ejection head is in a standby state in which the ink is not ejected.

BRIEF DESCRIPTION OF THE DRAWINGS

FIG. 6 is a diagram illustrating first setting conditions for an upper limit value and a lower limit value of the vacuum level.

FIG. 7 is a diagram illustrating second setting conditions for an upper limit value and a lower limit value of the vacuum level.

FIG. 8 is a diagram illustrating third setting conditions for an upper limit value and a lower limit value of the vacuum level.

FIG. 9 is a diagram illustrating fourth setting conditions for an upper limit value and a lower limit value of the vacuum level.

DESCRIPTION OF EXEMPLARY EMBODIMENTS

Hereinafter, an embodiment of a recording device will be described with reference to the drawings. An ink jet recording device according to the embodiment is a recording device that forms an image such as characters and photos on a recording target medium such as a recording sheet by ejecting an ultraviolet curable ink as an example of ink.

Configuration of Ink Jet Recording Device

The ink jet recording device according to the embodiment includes: an ejection head that ejects an ultraviolet curable ink; an ink flow path that supplies the ultraviolet curable ink to the head; and a feeding pump that distributes the ultraviolet curable ink to the ink flow path. Here, the "ink flow path" is a flow path through which the ink is distributed in the ink jet recording device. As the ink flow path, an ink supply path for supplying the ink from an ink accommodation container in which the ink is stored to an ink jet recording head, a flow path for distributing the ink up to a nozzle opening in the ink jet recording head, and the following ink circulation path are listed as examples, for example.

Figure 1:
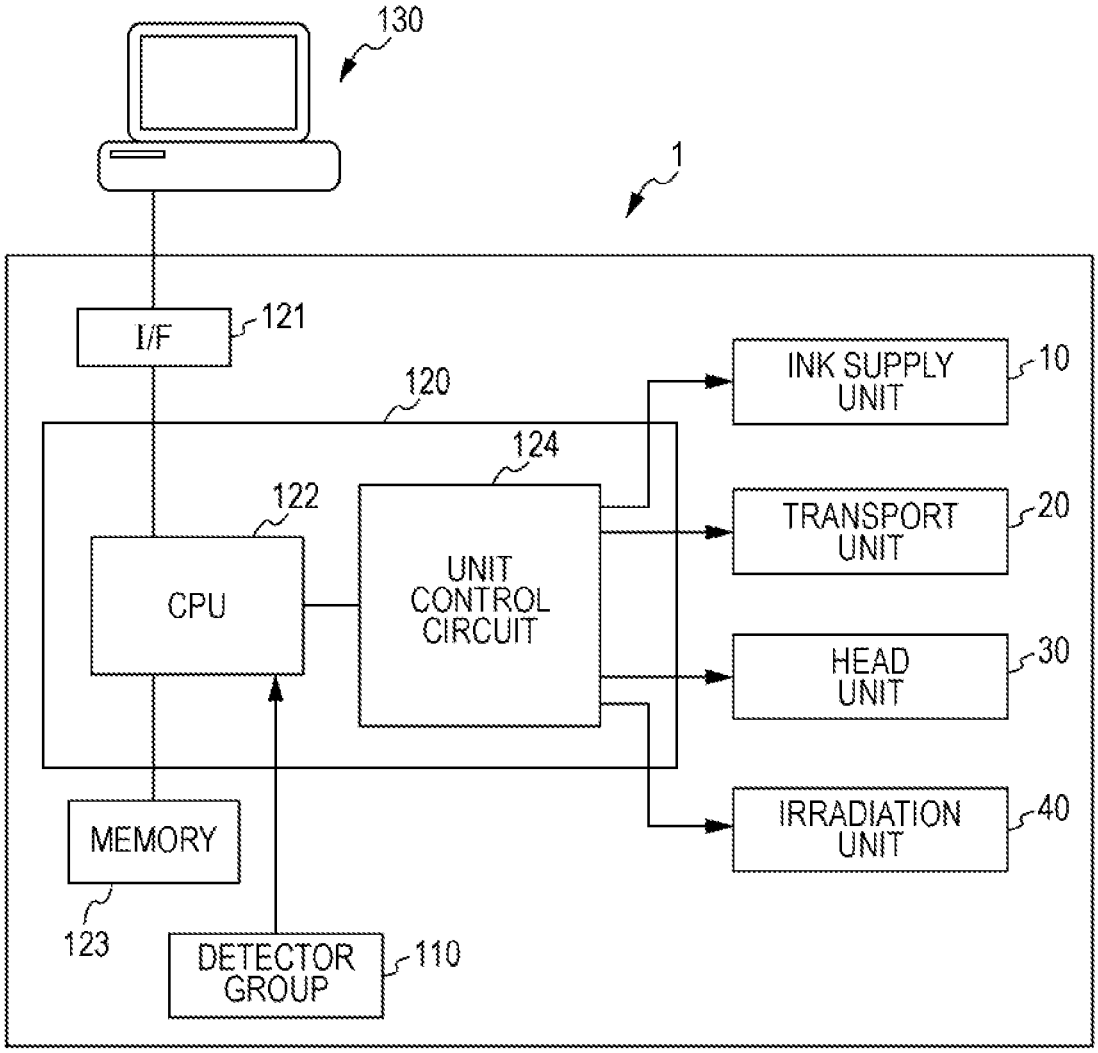
FIG. 1 is a block diagram illustrating an embodiment of a recording device.

FIG. 1 is a block diagram illustrating an example of a configuration of the ink jet recording device (hereinafter, also referred to as a "printer") according to the embodiment. A computer 130 outputs print data in accordance with an image to a printer 1 in order to cause the printer 1 to form the image. The printer 1 is a recording device that forms an image on a recording target medium as a recording medium and is coupled to the computer 130, which is an external device, in a communicable manner.

The printer 1 has an ink supply unit 10, a transport unit 20, a head unit 30, an irradiation unit 40, a detector group 110, a memory 123, an interface 121, and a controller 120. The printer 1 receives print data from the computer 130, then controls respective units using the controller 120, and records an image on a recording target medium in accordance with the print data. A status in the printer 1 is monitored by the detector group 110, and the detector group 110 outputs a detection result to the controller 120. The controller 120 controls the respective units on the basis of the detection result output from the detector group 110. The controller 120 stores the print data input via the interface 121 in a memory 123 and has a CPU 122 and a unit control circuit 124. The memory 123 also stores control information for controlling the respective units.

The ink jet recording device may be a line printer. In a case of a line printer, durability of the feeding pump is particularly required since the amount of ink composition supplied is large, and the ink jet recording device according to the embodiment is thus particularly effective.

Figure 2:
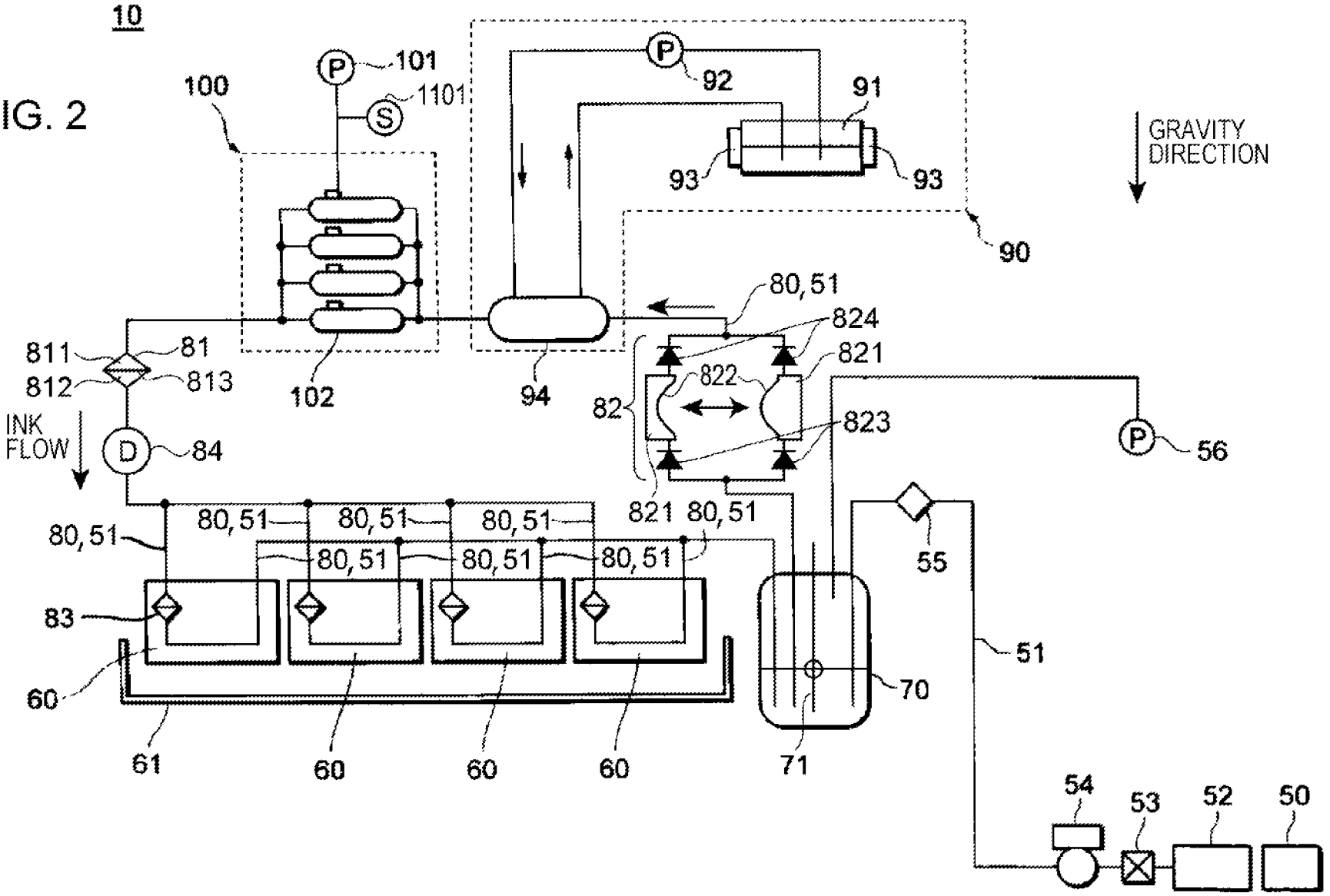
FIG. 2 is a diagram illustrating an example of an ink supply unit provided in the recording device.

FIG. 2 illustrates an example of an ink supply unit provided in the ink jet recording device according to the embodiment. The ink supply unit 10 is located between an ink cartridge 50 and an ejection head 60 in the ink jet recording device. The ink supply unit 10 includes a holder 52 to which the ink cartridge 50 is attached, an ink flow path 51 (preferably, an ink flow path 51 that includes an ink circulation path 80), a valve 53 that opens and closes the ink flow path 51, a sub-tank 70, a supply pump 54 that supplies ink in the ink cartridge 50 to the sub-tank 70, a filter 55 that filters the ink to be supplied to the sub-tank 70, a feeding pump 82, a warming device 90, a deaeration device 100, a filter unit 81, a damper unit 84, and an ejection head 60. The ejection head 60 belongs to the aforementioned head unit 30.

Sub-Tank

The ink jet recording device according to the embodiment preferably includes a sub-tank (the sub-tank 70 illustrated in FIG. 2, for example) that serves as a liquid reservoir for storing the ink at the ink flow path 51. The sub-tank 70 is coupled to the ink flow path 51 such that the ink is supplied from the ink cartridge 50, the internal space is opened to ambient air during recording, and a liquid surface may be adjusted such that a pressure applied to the stored ink by the ambient air is lower than an atmospheric pressure at a nozzle surface in which the nozzle of the ejection head 60 is opened, and that a pressure (for example, −1000 Pa to −3500 Pa lower than the atmospheric pressure, specifically −1900 Pa in the embodiment) with which a gas-liquid interface (meniscus) formed in the nozzle does not break. When the ink in the sub-tank is consumed through recording operations, the supply pump 54 may be driven to replenish the ink from the ink cartridge 50 and adjust the pressure to be applied to the stored ink by the atmospheric air. Also, the sub-tank 70 may be coupled to a pressurization pump 56 such that an internal space can be pressurized, adjust the pressure to be applied to the stored ink to a positive pressure that is higher than the atmospheric pressure with which the gas-liquid interface in the nozzle breaks, and perform cleaning of forcibly causing the nozzle to discharge the ink. A liquid amount sensor 71 that detects the amount of ink stored in the sub-tank 70 is disposed in the sub-tank 70. Also, the ink jet recording device according to the embodiment is provided with a cap 61 that can cover a nozzle surface of the ejection head 60.

Feeding Pump

The ink jet recording device according to the embodiment preferably includes a feeding pump (the feeding pump 82 illustrated in FIG. 2, for example) that distributes the ink in the ink flow path. The feeding pump 82 is preferably provided in a position between the sub-tank 70 and the warming device 90 in the ink flow path 51 in an exchangeable manner. The feeding pump 82 may include pump chambers 821, a suctioning-side flow path provided with a one-way valve 823 that is located at the pump chamber 821 on the side of the sub-tank 70, allows a flow of the ink toward the pump chamber 821, and restricts a flow of the ink toward the sub-tank 70, and an ejection-side flow path provided with a one-way valve 824 that is located at the pump chamber 821 on the side of the ejection head 60, allows a flow of the ink toward the ejection head 60, and restricts a flow of the ink toward the pump chamber 821, as illustrated in FIG. 2. The feeding pump 82 may employ a diaphragm pump that is categorized in a displacement pump that feeds a solution through repetition of a suctioning operation of deforming the diaphragm 822 formed of a flexible member as a flexible wall such that the volume in the pump chamber increases and an ejecting operation of deforming the diaphragm 822 such that the volume in the pump chamber decreases. The diaphragm pump may employ a two-phase type of including two of a suctioning-side flow path, a pump chamber 821, and an ejection-side flow path and reducing pulsation (pressure variation) of the fed solution by causing phases of repeated operations including a suctioning operation and an ejecting operation to deviate by 180 degrees, or may employ duckbill valves as one-way valves 823 and 824. The posture of the feeding pump 82 may be set such that the suction-side flow path extending in the gravity direction in FIG. 2 is coupled below a center of the pump chamber 821 in a posture in which the diaphragm serves as a side surface in the gravity direction and the ejection-side flow path extending in the gravity direction is coupled above the center of the pump chamber 821 in the gravity direction, in consideration of air bubble discharge properties. The diaphragm 822 may be formed of ethylene propylene diene monomer (EPDM) rubber from the viewpoint of ink resistance, or a fluorine resin (polytetrafluoroethylene) layer may be provided on the surface of EPDM on the side on which it serves as an inner surface of the pump chamber.

Figure 3:
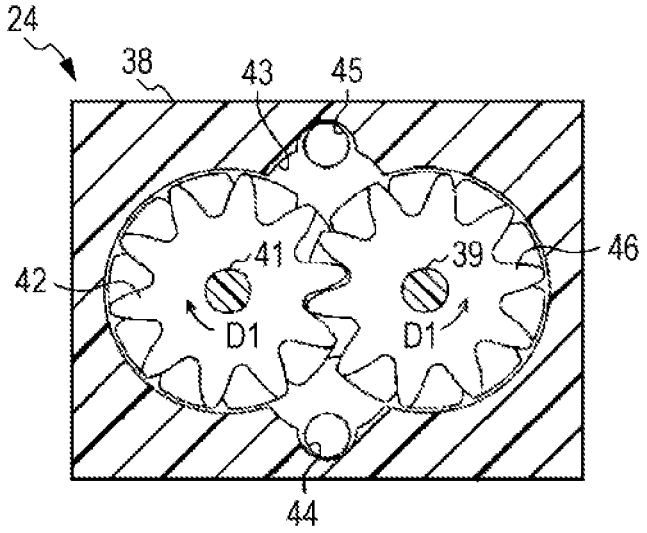
FIG. 3 is a schematic sectional view illustrating a configuration of a gear pump as an example of a feeding pump.

As the feeding pump, a tube pump that is categorized as a displacement pump that feeds a solution by deforming a tube that serves as a pump chamber with flexibility that forms as a part of the ink flow path with a roller may be employed, or a gear pump 24 illustrated in FIG. 3 may be employed. The diaphragm pump, the tube pump, and the gear pump may be employed as the supply pump 54. When the tube pump is employed, a material of the tube is preferably formed of an olefin-based material (for example, TRANSMASTER "TM-15" or the like, which is a name of a product manufactured by Mitsuboshi Co., Ltd.).

The gear pump 24 includes a case 38, a driving shaft 39, a driving gear 46 that integrally rotates with the driving shaft 39, a driven shaft 41, and a driven gear 42 that integrally rotates with the driven shaft 41. That is, the driving gear 46 and the driven gear 42 function as rotating bodies that rotate about the driving shaft 39 and the driven shaft 41 as shafts. In FIG. 3, the driving shaft 39 and the driven shaft 41 are provided in parallel to each other. The driving gear 46 and the driven gear 42 are a pair of helical gears that can rotate independently and are accommodated in a pump chamber 43 (flow body chamber) in a mutually engaged state. In the pump chamber 43, a suctioning port 44 and an ejection port 45 to which the ink circulation path 80 is coupled are formed. When the driving shaft 39, the driving gear 46, the driven shaft 41, and the driven gear 42 rotate in a positive direction D1 as represented by the arrow in FIG. 3, the gear pump 24 suctions the ink from the suctioning port 44 with rotating motion of the driving gear 46 and the driven gear 42 and ejects the ink from the ejection port 45 while causing the ink to flow in the pump chamber 43.

The gear pump 24 preferably includes a non-metal material at least in a surface of an engagement portion of the driving gear 46 that is a member with the engagement portion (groove), which comes into contact with the ink, at which the member is engaged with another member, and preferably contains at least one selected from a group consisting of polyphenylene sulfide, polyethylene terephthalate, polybutylene terephthalate, and ceramic. Ceramic is preferably one or more of metal oxide, metal carbide, metal nitride, metal boride, and the like. In this manner, durability of the ink jet recording device is further improved. Although the reasons for the improvement in durability are considered to be because swelling of the members due to ink constituents when these materials come into contact with the ink is small, these materials contain less impurities, less foreign matters may thus be generated from the constituents contained in the ink due to the impurities, and less failures may thus occur in rotation due to engagement failures of the members due to the swelling and the foreign matters, the reasons are not limited thereto. Although at least the surface of the case 38 that comes into contact with the ink can also be formed of the aforementioned material, the surface may be formed of a material with gas permeability (oxygen permeability) (such as polyacetal, polypropylene, polyethylene, polycarbonate, or silicone rubber). In this manner, it is possible to further curb sticking of the ink composition in the gear pump 24, and durability of the ink jet recording device is further improved.

The amount of ink fed by the feeding pump is preferably equal to or greater than 10 g/minute, is more preferably equal to or greater than 50 g/minute, is further preferably equal to or greater than 70 g/minute, is particularly preferably 100 g/minute, and is yet further preferably equal to or greater than 200 g/minute. Also, the amount of ink fed is preferably equal to or less than 400 g/minute and is more preferably equal to or less than 300 g/minute. When the amount of fed solution is within the aforementioned range, it is possible to secure a printing speed by supplying a necessary amount of ink for printing to the head and to secure durability of the feeding pump, which is favorable. When a circulation path through which the ink is circulated is provided, oxygen dissolved in the ink and the temperature are easily maintained within predetermined ranges. Therefore, the ink can be more stably supplied, the amount of oxygen dissolved in the ink and the temperature are more stabilized, and also, durability of the feeding pump is further improved, by the amount of the ink fed being within the aforementioned range.

Warming Device

The ink jet recording device according to the embodiment preferably includes a warming device (for example, the warming device 90 illustrated in FIG. 2) for warming the ink in the ink flow path. When the warming device is provided, there is a trend that viscous substances are likely to be generated in the ink composition due to a high temperature of the ink. When the viscous substances are generated, the gear pump employed as the feeding pump is likely to stick, for example. Therefore, the ink jet recording device according to the embodiment is particularly effective when the warming device is provided. The warming temperature is preferably 35 to 70° C.

Although the warming device 90 is not particularly limited as long as the warming device 90 is provided in the ink flow path, the warming device 90 is provided in the ink circulation path 80, and more specifically, at a midpoint of the ink flow path 51 that forms the ink circulation path 80, that is, a position between the feeding pump 82 and a deaerator 102 in FIG. 2. In this manner, it is possible to further improve durability of the feeding pump by the ink before being warmed with the warming device flowing into the feeding pump. The warming device 90 is adapted to warm the ink. With the warming device, it is possible to control the ejection temperature and the ejection viscosity of the ink to be ejected. The ejection temperature is preferably 28 to 50° C., is more preferably 28 to 45° C., and is further preferably 28 to 40° C. The ejection viscosity is preferably equal to or less than 15 mPa·S and is more preferably 5 to 15 mPa·S.

Although the warming device 90 is not particularly limited, a warming device that warms the ink in the ink circulation path 80 with a temperature adjustment module 94 while circulating warm water in a warm water tank 91 between the temperature adjustment module 94 and the warm water tank 91 with a warm water circulation pump 92 is listed as an example. A heater 93 of the warm water tank 91 is adapted to adjust the temperature of the ink to be circulated to a target temperature.

Deaeration Device

The ink jet recording device according to the embodiment preferably further has a deaeration device in the ink flow path. The deaeration device is adapted to deaerate the ink. Although the deaeration device 100 is not particularly limited as long as the deaeration device 100 is provided in the ink flow path, the deaeration device 100 can be provided in the ink circulation path 80, more specifically at a midpoint of the ink flow path 51 that forms the ink circulation path 80, that is, at a position between the temperature adjustment module 94 and the filter unit 81. The ink deaerated by the deaeration device 100 is supplied to the ejection head 60. The deaeration device 100 is preferably provided at a position between the warming device 90 (more specifically, the temperature adjustment module 94 of the ink circulation path 80) on upstream of the ejection head 60 and the filter unit 81 in a direction in which the ink is supplied. In this manner, the deaeration device 100 is located on downstream of the warming device 90, deaeration is performed in a state in which the temperature of the ink is high, and it is thus possible to further enhance deaeration efficiency. The deaerator 102 includes a deaeration chamber (not illustrated) into which the ink flows and a pressure reducing chamber (not illustrated) that is in contact with the deaeration chamber via a separation film that does not cause a liquid such as ink to pass therethrough. The pressure reducing pump 101 that serves as a vacuum level adjustment mechanism is adapted to reduce the pressure in the pressure reducing chamber. When the pressure in the pressure reducing chamber is reduced, the amount of air dissolved in the ink in the ink circulation path 80 is reduced to remove air bubbles. In this manner, the deaeration device 100 can deaerate the ink in the ink circulation path 80. A pressure sensor 1101 that serves as the detector group 110 is provided between the deaerator 102 and the pressure reducing pump 101, and the controller 120 that serves as a control portion controls the pressure reducing pump 101 that serves as the vacuum level adjustment mechanism and adjusts a vacuum level in the deaerator 102 on the basis of a pressure value detected by the pressure sensor 1101. Although the amount of oxygen dissolved in the ink flowing out of the pressure reducing and deaeration devices tends to decrease within a range of 5% on the assumption that the amount of oxygen dissolved in the ink flowing into the deaeration device is 100%, the amount (concentration) of oxygen dissolved in the ink in the ink circulation path 80 is stabilized during printing by the ink being circulated. The deaeration device 100 is preferably provided on downstream of the feeding pump and on upstream of the ejection head 60 in the direction in which the ink is supplied. It is possible to further improve durability of the feeding pump by causing the ink before deaerated by the deaeration device to flow into the feeding pump.

Although the deaeration device is not particularly limited, a deaeration device provided with a separation film that performs deaeration while feeding the ink may be listed as an example.

Filter Unit

The ink jet recording device according to the embodiment preferably includes, in the ink flow path, a filter unit (for example, the filter unit 81 illustrated in FIG. 2) that filters foreign matters in the ink. Specifically, the filter unit 81 is exchangeably provided at a position between the deaerator 102 and the damper unit 84 in the ink flow path 51. The filter unit 81 includes a filter 813, and an upstream filter chamber 811 located on the side of the sub-tank 70 and a downstream filter chamber 812 located on the side of the ejection head 60 that are sectioned by the filter 813. The filter unit 81 is detachably provided at a position of the ink flow path 51 above the nozzle surface of the ejection head 60 in a posture in which the upstream filter chamber 811 is located above the downstream filter chamber 812 in the gravity direction. When a head filter 83 is provided at the ejection head 60 as illustrated in FIG. 2, the filtration particle size of the filter 813 is preferably set to be smaller (5 μm, for example) than the filtration particle size (10 μm to 20 μm, for example) of the head filter 83, and the filter area of the filter 813 is also preferably set to be larger than that of the head filter 83.

Damper Unit

The ink jet recording device according to the embodiment preferably includes, in the ink flow path, a damper unit (for example, the damper unit 84 illustrated in FIG. 2) that reduces a variation in pressure of the ink. Specifically, the damper unit 84 is exchangeably provided between the filter unit 81 and the ejection head 60 in the ink flow path 51 at a position below the filter unit 81 in the gravity direction and above the nozzle surface of the ejection head 60. A damper chamber (not illustrated) of the damper unit 84 is formed of a pair of flexible films (which is formed of EPDM, has a diameter of about ϕ35 mm, and has a thickness of about 1 mm) that face each other with an annular inner wall (corresponding to a thickness direction of the damper chamber and having a thickness of about 10 mm) in between and is disposed in a posture such that a direction in which the flexible films face each other corresponds to a horizontal direction. It is possible to maintain appropriate swelling even when an ultraviolet curable ink is used as in the embodiment, and damper properties are not degraded by forming the flexible films using ethylene propylene diene monomer (EPDM) rubber, which are preferable as the flexible films.

Ink Circulation Path

The ink flow path preferably further has an ink circulation path, and the ink jet recording device further includes the deaeration device and the feeding pump in the ink circulation path. The ink flow path preferably has an ink circulation path in at least a part thereof. In FIG. 2, the ink flow path 51 forms a part of the ink circulation path 80, the ink circulation path 80 is continuous to the sub-tank 70 and the ejection head 60, the ink us supplied to the sub-tank 70, and the ink can thus be supplied to the ejection head 60. In this manner, the temperature of the ink warmed with the warming device 90 is constantly maintained, deaeration efficiency is further enhanced, the ink is caused to constantly flow, and it is thus possible to prevent constituents contained in the ink from sinking, by circulating the ink with the ink circulation path 80.

The amount of oxygen dissolved in the ink in the ink circulation path 80 is determined by the amount of oxygen dissolved in the ink accommodated in the ink cartridge 50 and the deaeration capability of the deaeration device 100, specifically, the ability of the pressure reducing pump 101 that serves as a vacuum level adjustment mechanism for adjusting a vacuum level (pressure reduced level) in the deaerator 102. The amount of oxygen dissolved in ink slightly increases by oxygen from the outside being dissolved in the ink in the process in which the ink before deaeration is successively replenished from the sub-tank 70 to the ink circulation path 80 with consumption of the ink and the ink is fed from the ink cartridge 50 to the ink circulation path 80 and during circulation. Therefore, it is possible to supply the ink in which the amount of oxygen dissolved is an upper limit value or less of a predetermined range to the ejection head 60 by providing the deaeration device 100 at a position between the feeding pump 82 in the ink flow path 51, which forms a part of the ink circulation path 80, and the ejection head 60 and by the controller 120 that serves as the control portion controlling the pressure reducing pump 101 as the vacuum level adjustment mechanism to adjust the vacuum level in the deaerator 102 such that the amount of oxygen dissolved in the ink that flows into the feeding pump 82 in the ink circulation path 80 is within the predetermined range. Accordingly, it is possible to reduce supply of air bubbles as foreign matters to the ejection head 60 and accumulation of air bubbles in the ejection head 60 and to improve ink ejection stability of the ejection head 60. Since the controller 120 as a control portion can adjust the vacuum level in the deaerator 102 in accordance with statuses of operations executed, such as an ink filling operation of filling either the ejection head 60 or the ink flow path 51 with ink, a recording operation of performing recording by ejecting the ink from the ejection head 60 onto the recording target medium, a cleaning operation of cleaning either the ejection head 60 or the ink flow path 51, and a standby state in which the ejection head 60 waits without ejecting the ink, it is possible to adjust the vacuum level in the deaerator 102 to be low, curb generation of foreign matters from the ink due to continuation of a state in which the concentration of oxygen dissolved in the ink is low, and reduce operation failures of the feeding pump and unstable ejection from the head when the lower limit value of the concentration range of the amount of oxygen dissolved in the ink in the ink circulation path 80 required for the status of the operation to be executed is high, for example.

Ink

The ultraviolet curable ink jet recording ink as the ink used in the embodiment contains a polymerization inhibitor and can also contain the respective constituents listed below, as needed. The ultraviolet curable ink jet recording ink is adapted to be distributed through the ink flow path, is fed to the head, and is then ejected from the head in the aforementioned ink jet recording device.

Polymerization Inhibitor

The ink used in the embodiment contains a hindered amine compound as a polymerization inhibitor. Typically, it is more difficult to obtain an effect of reducing ink polymerization due to oxygen (dark reaction) as the amount of oxygen dissolved in the ultraviolet curable ink is smaller. Also, a polymerization inhibitor such as p-methoxyphenol (MEHQ) does not act as a polymerization inhibitor when the amount of oxygen dissolved is small. Therefore, there is a trend that the ink composition sticks to the inside of the gear pump especially when a gear pump is employed as a feeding pump. However, since the hindered amine compound acts as a polymerization inhibitor even when the amount of oxygen is small, it is possible to curb the sticking of the ink composition to the inside of the gear pump even when the amount of oxygen dissolved is small.

Although the hindered amine compounds are not limited to the following examples, examples thereof include compounds having 2,2,6,6-tetramethylpiperidine-N-oxyl skeletons, compounds having 2,2,6,6-tetramethylpiperidine skeletons, compounds having 2,2,6,6-tetramethylpiperidine-N-alkyl skeletons, and compounds having 2,2,6,6-tetramethylpiperidine-N-acyl skeletons. The ink jet recording device achieves more excellent durability by using such a hindered amine compound.

Examples of commercially available hindered amine compounds include ADEKASTAB LA-7RD (2,2,6,6-tetramethyl-4-hydroxypiperidine-1-oxyl) (a name of product manufactured by ADEKA), IRGASTAB UV 10 (4,4'-[1,10-dioxo-1,10-decanediyl]bis(oxy))bis[2,2,6,6-tetramethyl]-1-piperidinyloxy) (CAS.2516-92-9) and TINUVIN 123 (4-hydroxy-2,2,6,6-tetramethylpiperidine-N-oxyl) (all of which are names of products manufactured by BASF), FA-711HM and FA-712HM (2,2,6,6-tetramethylpiperidinyl methacrylate; names of products manufactured by Hitachi Chemical Company, Ltd.), TINUVIN 11FDL, TINUVIN 144, TINUVIN 152, TINUVIN 292, TINUVIN 765, TINUVIN 770DF, TINUVIN 5100, SANOL LS-2626, CHIMASSORB 119FL, CHIMASSORB 2020 FDL, CHIMASSORB 944 FDL, and TINUVIN 622 LD (all of which are names of products manufactured by BASF), and LA-52, LA-57, LA-62, LA-63P, LA-68LD, LA-77Y, LA-77G, LA-81, LA-82 (1,2,2,6,6-pentamethyl-4-piperidyl methacrylate), and LA-87 (all of which are names of products manufactured by ADEKA).

Among the aforementioned commercially available products, LA-82 is a compound having a 2,2,6,6-tetramethylpiperidine-N-methyl skeleton, and ADEKASTAB LA-7RD and IRGASTAB UV 10 are compounds having 2,2,6,6-tetramethylpiperidine-N-oxyl skeletons. Among the aforementioned examples, it is preferable to use the compound having 2,2,6,6-tetramethylpiperidine-N-oxyl skeleton since it is possible to achieve more excellent ink storing stability and durability while maintaining excellent curability.

Although the specific examples of the aforementioned compound having a 2,2,6,6-tetramethylpiperidine-N-oxyl skeleton are not limited to the examples below, the examples include 2,2,6,6-tetramethyl-4-hydroxypiperidine-1-oxyl, 4,4'-[1,10-dioxo-1,10-decanediyl]bis(oxy)]bis[2,2,6,6-tetramethyl]-1-piperidinyloxy, 4-hydroxy-2,2,6,6-tetramethylpiperidine-N-oxyl, bis(l-oxyl-2,2,6,6-tetramethylpiperidine-4-yl)sebacate, and bis(2,2,6,6-tetramethyl-1-(octyloxy)-4-piperidinyl)sebacate.

One kind of hindered amine compound may be used alone, or two or more kinds thereof may be used in combination.

The content of the hindered amine compound is preferably 0.05 to 0.5% by mass, is more preferably 0.05 to 0.4% by mass, is further preferably 0.05 to 0.2% by mass, and is particularly preferably 0.06 to 0.2% by mass with respect to the total mass (100% by mass) of the ink composition. When the content thereof is equal to or greater than 0.05% by mass, it is possible to further curb sticking of the ink composition to the inside of the gear pump and to achieve more excellent durability. When the content thereof is equal to or less than 0.5% by mass, more excellent solubility is achieved.

Other Polymerization Inhibitors

The ink composition according to the embodiment may further contain polymerization inhibitors other than the hindered amine compound. Although other polymerization inhibitors are not limited to the examples below, the examples include p-methoxyphenol (hydroquinone monomethyl ether: MEHQ), hydroquinone, cresol, t-butylcatechol, 3,5-di-t-butyl-4-hydroxytoluene, 2,2'-methylenebis(4-methyl-6-t-butylphenol), 2,2'-methylenebis(4-ethyl-6-butylphenol), and 4,4'-thiobis(3-methyl-6-t-butylphenol).

One kind of other polymerization inhibitor may be used alone, or two or more kinds thereof may be used in combination. The content of other polymerization inhibitor is determined on the basis of a relationship with content of other constituents and is not particularly limited.

Amount of Oxygen Dissolved

The amount of oxygen dissolved in the ink that flows into the ink flow path including the feeding pump in the embodiment is preferably 2 to 20 ppm, is more preferably 5 to 20 ppm, and is further preferably 10 to 20 ppm. When the amount of oxygen dissolved is within the aforementioned range, it is possible to further curb precipitation of the ink composition as foreign matters in the ink flow path and sticking of the ink composition to the inside of the feeding pump, and the ink jet recording device achieves more excellent durability. The amount of oxygen dissolved in this specification can be measured by a method known in the related art, and values obtained by the measurement method used in the experiments conducted in the examples described below are employed. Although the deaeration processing to reduce the amount of oxygen dissolved to a predetermined value is not particularly limited, examples thereof include a method using a deaeration device such as pressure reducing deaeration and bubbling of inert gas. The amount of oxygen dissolved in the ink composition that flows into the feeding pump can be obtained by the method described in the examples.

Photopolymerization Initiator

The ink according to the embodiment can contain a photopolymerization initiator. The photopolymerization initiator is used to form printed characters by curing the ink that is present in the surface of the recording target medium through photopolymerization caused by irradiation with ultraviolet rays. The ink jet recording device according to the embodiment can achieve excellent safety and reduce costs for a light source by using ultraviolet (UV) rays among irradiation beams. The photopolymerization initiator is not limited as long as it generates active species such as radicals or cations using light (ultraviolet) energy and starts polymerization of a polymerizable compound, and it is possible to use a photo-radical polymerization initiator or a photo-cation polymerization initiator. Among these, it is preferable to use the photo-radical polymerization initiator. In a case in which the photo-radical polymerization initiator is used, there is a trend that polymerization advances when the amount of oxygen is small. Therefore, there is a trend that the viscosity of the ink increases in the gear pump, in which the oxygen tends to become insufficient, in the feeding pump, and the ultraviolet curable ink jet recording device according to the embodiment is particularly effective.

Although the aforementioned photo-radical polymerization initiator is not particularly limited, examples thereof include aromatic ketones, acylphosphine oxide compounds, thioxanthone compounds, aromatic onium salt compounds, organic peroxide, thio compounds (such as thiophenyl group-containing compounds), α-aminoalkylphenone compounds, hexaarylbiimidazole compounds, ketoxime ester compounds, borate compounds, azinium compounds, metallocene compounds, active ester compounds, compounds having carbon halogen bonds, and alkylamine compounds.

Among these, acylphosphine oxide-based photopolymerization initiators (acylphosphine oxide compounds) and thioxanthone-based photopolymerization initiators (thioxanethone compounds) are preferably used, and acylphosphine oxide-based photopolymerization initiators are more preferably used. A more excellent curing process using a UV-LED is achieved, and further excellent ink curability is achieved, by using the acylphosphine oxide-based photopolymerization initiator and the thioxanthone-based photopolymerization initiator, in particular, the acylphosphine oxide-based photopolymerization initiator. In a case in which such a photo-radical polymerization initiator is used, it is necessary to reduce the amount of oxygen dissolved in the ink since there are a trend that the viscosity of the ink composition further increases in the feeding pump and a trend that the ejection stability deteriorates when the amount of oxygen dissolved in the ink is large, which is disadvantageous in terms of durability, and the ultraviolet curable ink jet recording device according to the embodiment is thus especially effective.

Although the acylphosphine oxide-based photopolymerization initiator is not particularly limited, specific examples thereof include bis(2,4,6-trimethylbenzoyl)-phenylphosphineoxide, 2,4,6-trimethylbenzoyl-diphenyl-phosphineoxide, and bis-(2,6-dimethoxybenzoyl)-2,4,4-trimethylpentylphosphineoxide.

Although commercially available acylphosphine oxide-based photopolymerization initiators are not particularly limited, examples thereof include IRGACURE 819 (bis(2,4,6-trimethylbenzoyl)-phenylphosphineoxide) and DAROCUR TPO (2,4,6-trimethylbenzoyl-diphenyl-phosphineoxide).

The content of acylphosphine oxide-based photopolymerization initiator is preferably 2 to 15% by mass, is more preferably 5 to 13% by mass, and is further preferably 7 to 13% by mass with respect to the total mass (100% by mass) of the ink. When the content is equal to or greater than 2% by mass, there is a trend that further excellent ink curability is achieved. When the content is equal to or less than 13% by mass, there is a trend that ejection stability is more improved.

Although the thioxanthone-based photopolymerization initiator is not particularly limited, it is specifically preferable to contain one or more kinds selected from a group consisting of thioxanthone, diethylthioxanthone, isopropylthioxanthone, and chlorothioxanthone. Although not particularly limited, 2,4-diethylthioxanthone is preferably used as diethylthioxanthone, 2-isopropylthioxanthone is preferably used as isopropylthioxanthone, and 2-chrolothioxanthone is preferably used as chrolothioxanthone. There is a trend that the ink containing such a thioxanthone-based photopolymerization initiator has more excellent curability, storing stability, and ejection stability. Among these, the thioxanthone-based photopolymerization initiator containing diethylthioxanthone is preferably used. There is a trend that ultraviolet light (UV light) in a wide range can be efficiently converted into active species by containing diethylthioxanthone.

Although commercially available thioxanthone-based photopolymerization initiator is not particularly limited, specific examples thereof include SPEEDCURE DETX (2,4-diethylthioxanthone) and SPEEDCURE ITX (2-isopropylthioxanthone) (all of which are manufactured by Lambson), and KAYACURE DETX-S (2,4-diethylthioxanthone) (manufactured by Nippon Kayaku Co., Ltd.).

The content of thioxanthone-based photopolymerization initiator is preferably 0.5 to 4% by mass and is more preferably 1 to 4% by mass with respect to the total mass (100% by mass) of the ink. When the content is equal to or greater than 0.5% by mass, there is a trend that further excellent ink curability is achieved. When the content is equal to or less than 4% by mass, more excellent ejection stability is achieved.

Although other photo-radical polymerization initiators are not particularly limited, examples thereof include acetophenone, acetophenonebenzylketal, 1-hydroxycyclohexylphenylketone, 2,2-dimethoxy-2-phenylacetophenone, xanthone, fluorenone, benzaldehyde, fluorene, anthraquinone, triphenylamine, carbazole, 3-methylacetophenone, 4-chlorobenzophenone, 4,4'-dimethoxybenzophenone, 4,4'-diaminobenzophenone, Michler's ketone, benzoin propyl ether, benzoin ethyl ether, benzyl dimethyl ketal, 1-(4-isopropylphenyl)-2-hydroxy-2-methylpropane-1-one, 2-hydroxy-2-methyl-1-phenylpropane-1-one, and 2-methyl-1-[4-(methylthio)phenyl]-2-morpholino-propane-1-one.

Although commercially available photo-radical polymerization initiators are not particularly limited, examples thereof include IRGACURE 651 (2,2-dimethoxy-1,2-diphenylethane-1-one), IRGACURE 184 (1-hydroxy-cyclohexyl-phenyl-ketone), DAROCUR 1173 (2-hydroxy-2-methyl-1-phenyl-propane-1-one), IRGACURE 2959 (1-[4-(2-hydroxyethoxy)-phenyl]-2-hydroxy-2-methyl-1-propane-1-one), IRGACURE 127 (2-hydroxy-1-{4-[4-(2-hydroxy-2-methyl-propynoyl)-benzyl]phenyl}-2-methyl-propane-1-one), IRGACURE 907 (2-methyl-1-(4-methylthiophenyl)-2-morpholinopropane-1-one), IRGACURE 369 (2-benzyl-2-dimethylamino-1-(4-morpholinophenyl)-butanone-1), IRGACURE 379 (2-(dimethylamino)-2-[(4-methylphenyl) methyl]-1-[4-(4-morpholinyl)phenyl]-1-butanone), IRGACURE 784 (bis(η5-2,4-cyclopentadien-1-yl)bis(2,6-difluoro-3-(1H-pyrrol-1-yl)-phenyl)titanium), IRGACURE OXE 01(1,2-octanedione, 1-[4-(phenylthio)-, 2-(o-benzoyloxime)]), IRGACURE OXE 02 (ethanon, 1-[9-ethyl-6-(2-methylbenzoyl)-9H-carbazole-3-yl]-, 1-(O-acetyloxime)), IRGACURE 754 (mixtures of oxyphenylacetic acid, 2-[2-oxo-2-phenylacetoxyethoxy]ethylester and oxyphenylacetic acid, and 2-(2-hydroxyethoxy)ethyl ester) (all of which are manufactured by BASF), SPEEDCURE TPO (which is manufactured by Lambson), LUCIRIN TPO, LR8893, and LR8970 (all of which are manufactured by BASF), and EBECRYL P36 (which is manufactured by UCB).

Although the cationic polymerization initiator is not particularly limited, specific examples thereof include a sulfonium salt and an iodonium salt. Although commercially available cationic polymerization initiators are not particularly limited, specific examples thereof include IRGACURE 250 and IRGACURE 270.

One kind of the aforementioned photopolymerization initiator may be used alone, or two or more kinds thereof may be used in combination.

The content of other photopolymerization initiator is preferably 5 to 20% by mass with respect to the total mass (100% by mass) of the ink. When the content is within the range, it is possible to sufficiently exhibit an ultraviolet curing speed and to avoid remaining of undissolved photopolymerization initiator and coloring due to the photopolymerization initiator.

Polymerizable Compound

The ink may contain a polymerizable compound. The polymerizable compound is polymerized alone or with an action of the photopolymerization initiator by light irradiation and can cure the printed ink. Although the polymerizable compound is not particularly limited, specific examples that can be used include a monofunctional, difunctional, trifunctional or higher functional monomers and oligomers that are known in the related art. One kind of polymerizable compound may be used alone, or two or more kinds thereof may be used in combination. Hereinafter, these polymerizable compounds will be listed as examples.

Although the monofunctional, difunctional, trifunctional or higher functional monomers are not particularly limited, examples thereof include: unsaturated carboxylic acid such as (meth)acrylic acid, itaconic acid, crotonic acid, isocrotonic acid, and maleic acid; salts of the unsaturated carboxylic acid; ester, urethane, amide, and anhydride of the aforementioned unsaturated carboxylic acid; and acrylonitrile, styrene, various kinds of unsaturated polyester, unsaturated polyether, unsaturated polyamide, and unsaturated urethane. Examples of the monofunctional, difunctional, trifunctional or higher functional oligomers include oligomers that are formed from the aforementioned monomers such as linear acryl oligomer, epoxy (meth)acrylate, oxetane (meth)acrylate, aliphatic urethane (meth)acrylate, aromatic urethane (meth)acrylate, and polyester (meth)acrylate.

As another monofunctional monomer or polyfunctional monomer, an N-vinyl compound may be contained. Although the N-vinyl compound is not particularly limited, examples thereof include N-vinylformamide, N-vinylcarbazole, N-vinylacetoamide, N-vinylpyrrolidone, N-vinylcaprolactam, and acryloylmorphorine, and derivatives thereof.

Among the polymerizable compounds, ester of (meth) acrylic acid, that is, (meth)acrylate is preferably used.

Although monofunctional (meth)acrylate is not particularly limited, examples thereof include isoamyl (meth)acrylate, stearyl (meth)acrylate, lauryl (meth)acrylate, octyl (meth)acrylate, decyl (meth)acrylate, isomyristyl (meth) acrylate, isostearyl (meth)acrylate, 2-ethylhexyl-dicrylol (meth)acrylate, 2-hydroxybutyl (meth)acrylate, butoxyethyl (meth)acrylate, ethoxydiethylene glycol (meth)acrylate, methoxydiethylene glycol (meth)acrylate, methoxy polyethylene glycol (meth)acrylate, methoxy propylene glycol (meth)acrylate, phenoxyethyl (meth)acrylate, tetrahydrofurfuryl (meth)acrylate, isobornyl (meth)acrylate, 2-hydroxyethyl (meth)acrylate, 2-hydroxypropyl (meth)acrylate, 2-hydroxy-3-phenoxypropyl (meth)acrylate, lactone-modified flexible (meth)acrylate, t-butylcyclohexyl (meth)acrylate, dicyclopentanyl (meth)acrylate, and dicyclopentenyloxyethyl (meth)acrylate. Among these, phenoxyethyl (meth) acrylate is preferably used.

The content of monofunctional (meth)acrylate is preferably 30 to 85% by mass and is more preferably 40 to 75% by mass with respect to the total mass (100% by mass) of the ink. There is a trend that more excellent curability, initiator solubility, storing stability, an ejection stability are achieved by setting the content within the aforementioned preferable range.

Examples of monofunctional (meth)acrylate include monofunctional (meth)acrylate containing a vinyl ether group. Although such monofunctional (meth)acrylate is not particularly limited, examples thereof include (meth)acrylic acid 2-vinyloxyethyl, (meth)acrylic acid 3-vinyloxypropyl, (meth)acrylic acid 1-methyl-2-vinyloxyethyl, (meth)acrylic acid 2-vinyloxypropyl, (meth)acrylic acid 4-vinyloxybutyl, (meth)acrylic acid 1-methyl-3-vinyloxypropyl, (meth) acrylic acid 1-vinyloxymethylpropyl, (meth)acrylic acid 2-methyl-3-vinyloxypropyl, (meth)acrylic acid 1,1-dimethyl-2-vinyloxyethyl, (meth)acrylic acid 3-vinylozybutyl, (meth)acrylic acid 1-methyl-2-vinyloxypropyl, (meth) acrylic acid 2-vinyloxybutyl, (meth)acrylic acid 4-vinyloxycyclohexyl, (meth)acrylic acid 6-vinyloxyhexyl, (meth) acrylic acid 4-vinyloxymethylcyclohexylmethyl, (meth) acrylic acid 3-vinyloxymethylcyclohexylmethyl, (meth) acrylic acid 2-vinyloxymethylcyclohexylmethyl, (meth) acrylic acid p-vinyloxymethylphenylmethyl, (meth)acrylic acid m-vinyloxymethylphenylmethyl, (meth)acrylic acid o-vinyloxymethylhenylmethyl, (meth)acrylic acid 2-(vinyloxyethoxy)ethyl, (meth)acrylic acid 2-(vinyloxyisopropoxy)ethyl, (meth)acrylic acid 2-(vinyloxyethoxy)propyl, (meth)acrylic acid 2-(vinyloxyethoxy)isopropyl, (meth) acrylic acid 2-(vinyloxyisopropoxy)propyl, (meth)acrylic acid 2-(vinyloxyisopropoxy)isopropyl, (meth)acrylic acid 2-(vinyloxyethoxyethoxy)ethyl, (meth)acrylic acid 2-(vinyloxyisopropoxyethoxy)ethyl, (meth)acrylic acid 2-(vinyloxyisopropoxyethoxy)ethyl, (meth)acrylic acid 2-(vinyloxyisopropoxyisopropoxy)ethyl, (meth)acrylic acid 2-(vinyloxyethoxyethoxy)propyl, (meth)acrylic acid 2-(vinyloxyethoxyisopropoxy)propyl, (meth)acrylic acid 2-(vinyloxyisopropoxyethoxy)propyl, (meth)acrylic acid 2-(vinyloxyisopropoyisopropoxy)propyl, (meth)acrylic acid 2-(vinyloxyethoxyethoxy)isopropyl, (meth)acrylic acid 2-(vinyloxyethoxyisopropoxy) isopropyl, (meth)acrylic acid 2-(vinyloxyisopropoxyethoxy)isopropyl, (meth)acrylic acid 2-(vinyloxyisopropoxyisopropoxy)isopropyl, (meth)acrylic acid 2-(vinyloxyethoxyethoxyethoxy)ethyl, (meth)acrylic acid 2-(vinyloxyethoxyethoxyethoxyethoxy)ethyl, (meth) acrylic acid 2-(isopropenoxyethoxy)ethyl, (meth)acrylic acid 2-(isopropenoxyethoxyethoxy)ethyl, (meth)acrylic acid 2-(isopropenoxyethoxyethoxy)ethyl, (meth)acrylic acid 2-(isopropenoxyethoxyethoxyethoxyethoxy)ethyl, (meth)acrylic acid polyethylene glycol monovinyl ether, and (meth)acrylic acid polypropylene glycol monovinyl ether, phenoxyethyl (meth)acrylate, isobornyl (meth)acrylate, and benzyl (meth)acrylate. Among these, (meth)acrylic acid 2-(vinyloxyethoxy)ethyl, phenoxyethyl (meth)acrylate, isobornyl (meth)acrylate, and benzyl (meth)acrylate are preferably used.

Among these, (meth)acrylic acid 2-(vinyloxyethoxy) ethyl, that is, at least either acrylic acid 2-(vinyloxyethoxy) ethyl or methacrylic acid 2-(vinyloxyethoxy)ethyl is preferably used, and acrylic acid 2-(vinyloxyethoxy)ethyl is more preferably used since it is possible to further reduce the viscosity of the ink and to achieve a high flashing point and excellent ink curability. Both acrylic acid 2-(vinyloxyethoxy)ethyl and methacrylic acid 2-(vinyloxyethoxy)ethyl can significantly reduce the viscosity of the ink due to their simple structures and small molecular weights. Examples of (meth)acrylic acid 2 (vinyloxyethoxy)ethyl include (meth) acrylic acid 2-(2-vinyloxyethoxy)ethyl and (meth)acrylic acid 2-(1-vinyloxyethoxy)ethyl, and examples of acrylic acid 2-(vinyloxyethoxy)ethyl include acrylic acid 2-(2-vinyloxyethoxy)ethyl and acrylic acid 2-(1-vinyloxyethoxy) ethyl. Also, acrylic acid 2-(vinyloxyethoxy)ethyl has more excellent curability than that of methacrylic acid 2-(vinyloxyethoxy)ethyl.

The content of the aforementioned vinyl ether group-containing (meth)acrylic acid esters, particularly (meth) acrylic acid 2-(vinyloxyethoxy)ethyl is preferably 10 to 70% by mass and is more preferably 30 to 50% by mass with respect to the total mass (100% by mass) of the ink. When the content is equal to or greater than 10% by mass, it is possible to reduce the viscosity of the ink and to achieve further excellent ink curability. Meanwhile, when the content is equal to or less than 70% by mass, it is possible to maintain ink storing stability in an excellent state.

In the aforementioned (meth)acrylate, examples of difunctional (meth)acrylate include triethylene glycol di(meth)acrylate, tetraethylene glycol di(meth)acrylate, polyethylene glycol di(meth)acrylate, dipropylene glycol di(meth)acrylate, tripropylene glycol di(meth)acrylate, polypropylene glycol di(meth)acrylate, 1,4-butanediol di(meth)acrylate, 1,6-hexanediol di(meth)acrylate, 1,9-nonanediol di(meth)acrylate, neopentyl glycol di(meth) acrylate, dimethylol-tricyclodecane di(meth)acrylate, bisphenol A ethylene oxide (EO) adduct di(meth)acrylate, bisphenol A propylene oxide (PO) adduct di(meth)acrylate, hydroxypivalic acid neopentyl glycol di(meth)acrylate, polytetramethylene glycol di(meth)acrylate, diethylene glycol di(meth)acrylate, triethylene glycol di(meth)acrylate, and trifunctional or higher functional (meth)acrylate having a pentaerythritol skeleton or a dipenta erythritol skeleton. Among these, dipropylene glycol di(meth)acrylate is preferably used. Among these, dipropylene glycol di(meth) acrylate, tripropylene glycol di(meth)acrylate, diethylene glycol di(meth)acrylate, triethylene glycol di(meth)acrylate, and trifunctional or higher functional (meth)acrylate having a pentaerythritol skeleton or a dipentaerythritol skeleton are preferably used. The ink composition more preferably contains polyfunctional (meth)acrylate in addition to monofunctional (meth)acrylate.

The content of difunctional or higher functional (meth) acrylate is preferably 5 to 60% by mass, is more preferably 15 to 60% by mass, and is further preferably 20 to 50% by mass with respect to the total mass (100% by mass) of the ink. There is a trend that more excellent curability, storing stability, and ejection stability are achieved by setting the content within the aforementioned preferable range.

In the aforementioned (meth)acrylate, examples of trifunctional or higher functional (meth)acrylate include trimethylolpropane tri(meth)acrylate, EO-modified trimethylolpropane tri(meth)acrylate, pentaerythritol tri(meth)acrylate, pentaerythritol tetra(meth)acrylate, dipentaerythritol hexa (meth)acrylate, ditrimethylolpropane tetra(meth)acrylate, glycerin propoxy tri(meth)acrylate, caprolactone-modified trimethylolpropane tri(meth)acrylate, pentaerythritolethoxy tetra(meth)acrylate, and caprolactam-modified dipentaerythritol hexa(meth)acrylate. The ink preferably contains trifunctional or higher functional (meth)acrylate in terms of ink curability, and the content thereof is preferably 5 to 40% by mass, is more preferably 5 to 30% by mass, and is further preferably 5 to 20% by mass with respect to the total mass (100% by mass) of the ink. Although an upper limit value of the number of functional groups of the polyfunctional (meth)acrylate is not limited, a hexafunctional or lower functional group is preferably employed in terms of low viscosity of the ink.

Among these, the polymerizable compound preferably contains monofunctional (meth)acrylate. In this case, the viscosity of the ink becomes low, excellent solubility of the photopolymerization initiator and other additives is achieved, and ejection stability is easily obtained during ink jet recording. Further, since stiffness, heat resistance, and chemical resistance of a coated film are enhanced, it is preferable to use monofunctional (meth)acrylate and difunctional (meth)acrylate together, and in particular, it is further preferable to use phenoxyethyl (meth)acrylate and dipropylene glycol di(meth)acrylate together.

The content of the aforementioned polymerizable compound is preferably 5 to 95% by mass and is more preferably 15 to 90% by mass with respect to the total mass (100% by mass) of the ink. When the content of the polymerizable compound is within the aforementioned range, it is possible to further reduce the viscosity and odor and to achieve further excellent solubility and reactivity of the photopolymerization initiator.

Coloring Material

The ink may further contain a coloring material. It is possible to use at least either a pigment or a dye as the coloring material.

Pigment

It is possible to improve light durability of the ink by using a pigment as a coloring material. As the pigment, both an inorganic pigment and an organic pigment can be used.

Examples of the inorganic pigment that can be used include carbon blacks (C.I. Pigment Black 7) such as furnace black, lamp black, acetylene black, and channel black, iron oxide, and titanium oxide.

Examples of the organic pigment include azo pigments such as an insoluble azo pigment, a condensed azo pigment, azo lake, and a chelate azo pigment, polycyclic pigments such as a phthalocyanine pigment, a perylene and perinone pigment, an anthraquinone pigment, a quinacridone pigment, a dioxane pigment, a thioindigo pigment, an isoindolinone pigment, and quinophthalone pigment, dye chelate (for example, basic dye-type chelate, acidic dye-type chelate, and the like), dye lake (basic dye-type lake and acidic dye-type lake), a nitro pigment, a nitroso pigment, an aniline black, and a daylight fluorescent pigment.

More specifically, examples of carbon black used for black ink include No. 2300, No. 900, MCF88, No. 33, No. 40, No. 45, No. 52, MA7, MA8, MA100, No. 2200B, and the like (all of which are manufactured by Mitsubishi Chemical Corporation), Raven 5750, Raven 5250, Raven 5000, Raven 3500, Raven 1255, Raven 700, and the like (all of which are manufactured by Carbon Columbia), Regal 400R, Regal 330R, Regal 660R, Mogul L, Monarch 700, Monarch 800, Monarch 880, Monarch 900, Monarch 1000, Monarch 1100, Monarch 1300, Monarch 1400, and the like (manufactured by CABOT JAPAN K.K.), and Color Black FW1, Color Black FW2, Color Black FW2V, Color Black FW18, Color Black FW200, Color Black S150, Color Black S160, Color Black S170, Printex 35, Printex U, Printex V, Printex 140U, Special Black 6, Special Black 5, Special Black 4A, and Special Black 4 (all of which are manufactured by Degussa).

Examples of a pigment used for white ink include C.I. Pigment white 6, 18, and 21.

Examples of a pigment used for yellow ink include C.I. Pigment yellow 1, 2, 3, 4, 5, 6, 7, 10, 11, 12, 13, 14, 16, 17, 24, 34, 35, 37, 53, 55, 65, 73, 74, 75, 81, 83, 93, 94, 95, 97, 98, 99, 108, 109, 110, 113, 114, 117, 120, 124, 128, 129, 133, 138, 139, 147, 151, 153, 154, 167, 172, and 180.

Examples of a pigment used for magenta ink include C.I. Pigment red 1, 2, 3, 4, 5, 6, 7, 8, 9, 10, 11, 12, 14, 15, 16, 17, 18, 19, 21, 22, 23, 30, 31, 32, 37, 38, 40, 41, 42, 48(Ca), 48(Mn), 57(Ca), 57:1, 88, 112, 114, 122, 123, 144, 146, 149, 150, 166, 168, 170, 171, 175, 176, 177, 178, 179, 184, 185, 187, 202, 209, 219, 224, and 245, and C.I. Pigment violet 19, 23, 32, 33, 36, 38, 43, and 50.

Examples of a pigment used for cyan ink include C.I. Pigment blue 1, 2, 3, 15, 15:1, 15:2, 15:3, 15:34, 15:4, 16, 18, 22, 25, 60, 65, and 66 and C.I. Pigment vat blue 4 and 60.

Examples of pigments other than magenta, cyan, and yellow include C.I. Pigment green 7 and 10, C.I. Pigment brown 3, 5, 25, and 26, and C.I. Pigment orange 1, 2, 5, 7, 13, 14, 15, 16, 24, 34, 36, 38, 40, 43, and 63.

One kind of pigment may be used alone, or two or more kinds thereof may be used together.

When the aforementioned pigment is used, an average particle diameter thereof is preferably equal to or less than 300 nm and is more preferably 50 to 200 nm. When the average particle diameter is within the aforementioned range, further excellent reliability of ink such as ejection stability and dispersion stability is achieved, and it is also possible to form an image with excellent image quality. Here, the average particle diameter in the specification is measured by a dynamic light scattering method.

Dye

As a coloring material, it is possible to use a dye. The dye is not particularly limited, and it is possible to use an acidic dye, a direct dye, a reactive dye, and a basic dye. Examples of the dye include C.I. acid yellow 17, 23, 42, 44, 79, and 142, C.I. acid red 52, 80, 82, 249, 254, and 289, C.I. acid blue 9, 45, and 249, C.I. acid black 1, 2, 24, and 94, C.I. food black 1 and 2, C.I. direct yellow 1, 12, 24, 33, 50, 55, 58, 86, 132, 142, 144, and 173, C.I. direct red 1, 4, 9, 80, 81, 225, and 227, C.I. direct blue 1, 2, 15, 71, 86, 87, 98, 165, 199, and 202, C.I. direct black 19, 38, 51, 71, 154, 168, 171, and 195, and C.I. reactive red 14, 32, 55, 79, and 249, and C.I. reactive black 3, 4, and 35.

One kind of the aforementioned dye may be used alone, or two or more kinds thereof may be used.

The content of the coloring material is preferably 1 to 20% by mass with respect to the total mass (100% by mass) of the ink since excellent hiding properties and color reproducibility can be achieved.

Dispersant

When the ink contains a pigment, the ink may further contain a dispersant for further satisfactory pigment dispersibility. Although the dispersant is not particularly limited, examples thereof include dispersants that are commonly used for preparing a pigment dispersion such as a polymer dispersant. Specific examples thereof include a dispersant that contains, as a main constituent, one or more kinds from polyoxyalkylene polyalkylene polyamine, vinyl-based polymers and copolymers, acrylic-based polymers and copolymers, polyester, polyamide, polyimide, polyurethane, amino-based polymers, silicon-containing polymers, sulfur-containing polymers, fluorine-containing polymers, and an epoxy resin. Examples of commercially available polymer dispersant include AJISPER Series manufactured by Ajinomoto Fine-Techno Co., Ltd., SOLSPERSE Series (such as SOLSPERSE 36000) available from Avecia and Noveon, DISPERBYK Series manufactured by BYK Chemie, and DISPARLON Series manufactured by Kusumoto Chemicals, Ltd.

Other Additives

The ink may contain additives (constituents) other than the additives listed above. Although such constituents are not particularly limited, the constituents may be a slipping agent (surfactant), a polymerization accelerator, a penetration accelerator, and a wetting agent (moisturizer), and other additives that are known in the related art. Examples of other additives described above include a fixing agent, an antifungal agent, a preservative, an antioxidant, an ultraviolet absorber, a chelating agent, a pH adjuster, and a thickener that are known in the related art.

Preparation of Ink

The ink can be prepared by uniformly mixing the dye and other additive constituents, as needed, and removing undissolved substances with a filter. The preparation method is not particularly limited, and a known method can be used.

Concerning Adjustment of Vacuum Level in Deaerator

Next, adjustment of a vacuum level in the deaerator which is an example of a maintenance method for the printer 1 as a recording device, will be described. In regard to the adjustment of the vacuum level in the deaerator, the controller 120 that serves as a control portion controls the pressure reducing pump 101 that serves as a vacuum level adjustment mechanism and adjusts the vacuum level in the deaerator 102 on the basis of a pressure value detected by the pressure sensor 1101 such that the amount of oxygen dissolved in the ink in the ink circulation path 80 is within a concentration range required for a status of an operation to be executed when the aforementioned operations including the standby state are executed on the basis of experiment results of {evaluation tests} regarding a relationship between the vacuum level (absolute pressure) in the deaerator and the amount of oxygen dissolved in the ink and a relationship between the amount of oxygen dissolved in the ink and ejection stability, which will be described later.

Figure 4:
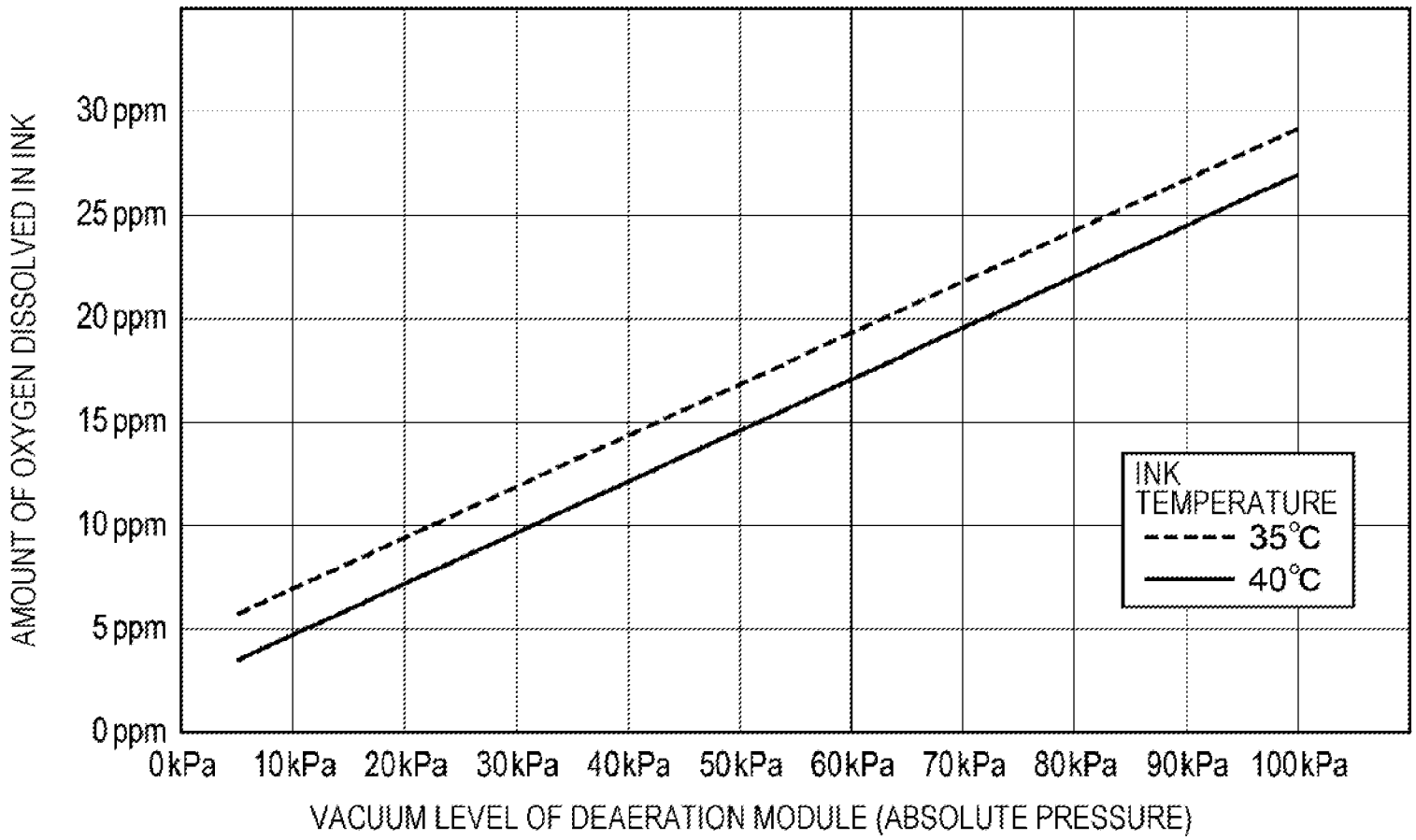
FIG. 4 is a diagram illustrating a relationship between a vacuum level in a deaerator and the amount of oxygen dissolved in ink.

Relationship Between Vacuum Level (Absolute Pressure) in Deaerator and Amount of Oxygen Dissolved in Ink FIG. 4 is a diagram illustrating a relationship between a vacuum level (absolute pressure) in the deaerator 102 and the amount of oxygen dissolved in the ink based on the experiment results. In the following description, a case in which a numerical value representing the vacuum level (absolute pressure) is small will be referred to as a high vacuum level while a case in which the numerical value representing the vacuum level (absolute pressure) is large will be referred to as a low vacuum level for convenience.

It is a matter of course that more air is removed from the ink as the vacuum level in the deaerator 102 is higher. Since oxygen is contained in the air at a specific proportion, the amount of oxygen dissolved in the ink decreases as more air is removed. That is, the amount of oxygen dissolved decreases as the vacuum level becomes higher. Accordingly, when the amount of oxygen dissolved in the ink is adjusted to be within a predetermined range, it is only necessary to control drive of the pressure reducing pump 101 such that the vacuum level in the deaerator 102 is between an upper limit value on a lower vacuum level side in the deaerator 102 corresponding to an upper limit value of a predetermined range of the amount of oxygen dissolved and a lower limit value on a higher vacuum level side in the deaerator 102 corresponding to a lower limit value of the predetermined range of the amount of oxygen dissolved, on the basis of the relationship between the vacuum level (absolute pressure) in the deaerator 102 and the amount of oxygen dissolved in the ink obtained in advance through experiments or the like.

Figure 5:
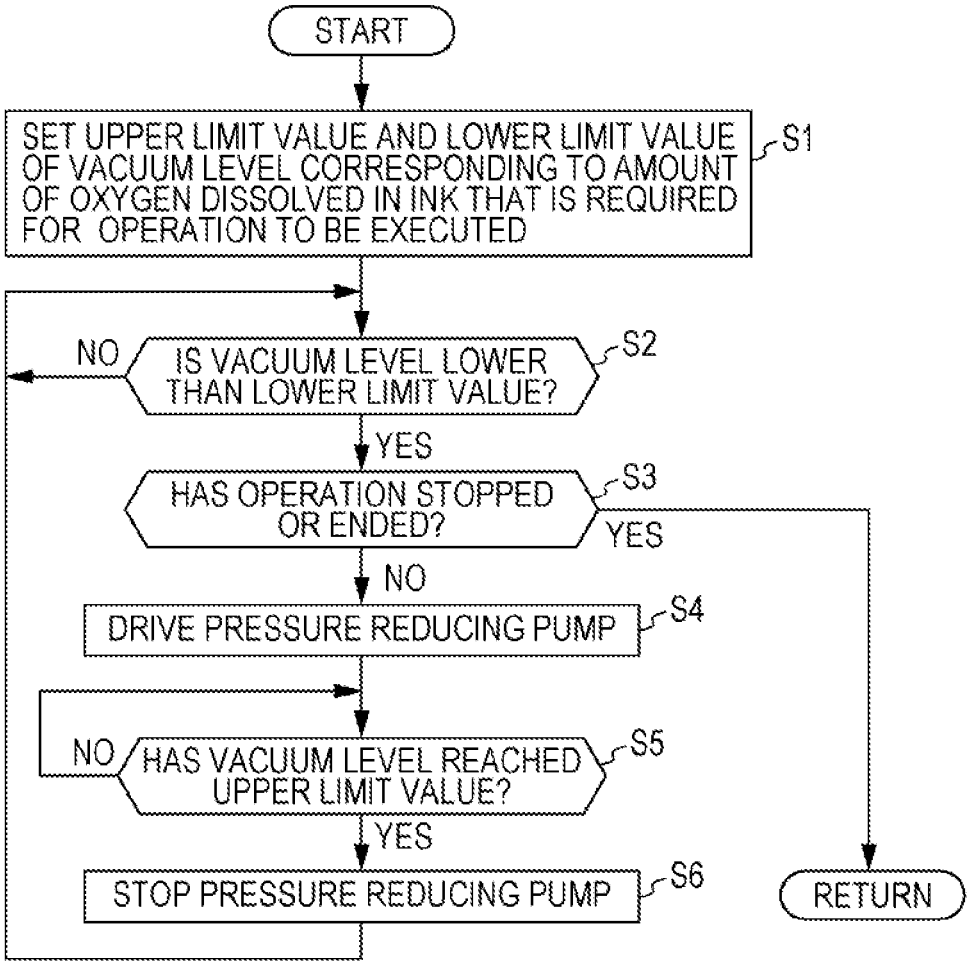
FIG. 5 is a flowchart illustrating an example of processing for adjusting a vacuum level in the deaerator.

Specific adjustment of the vacuum level in the deaerator will be described on the basis of FIG. 5. The control portion (controller 120) that executes the adjustment of the vacuum level in the deaerator sets the upper limit value and the lower limit value of the vacuum level corresponding to the amount of oxygen dissolved in the ink required for an operation to be executed to values obtained in advance from experiment results in Step S1. When the first setting conditions (setting of the upper limit value and the lower limit value of the vacuum level) illustrated in FIG. 6, for example, are used, and an operation to be executed is an ink filling operation, the control portion monitors whether or not the pressure value (the vacuum level in the deaerator 102) detected by the pressure sensor 1101 is lower than the lower limit value (25 kPa) in Step S2. The control portion continues to monitor the vacuum level when the vacuum level is higher than the lower limit value in Step S2, and the control portion moves on to Step S3 when the vacuum level is lower than the lower limit value. When the ink filling operation is executed in Step S3, the control portion moves on to Step S4 to drive the pressure reducing pump 101. When the ink filling operation is stopped or ended in Step S3, the control portion ends the adjustment of the vacuum level corresponding to the ink filling operation and performs adjustment of the vacuum level corresponding to another operation status. In Step S5, the control portion monitors whether or not the pressure value (the vacuum level in the deaerator 102) detected by the pressure sensor 1101 has reached the upper limit value (5 kPa) while driving the pressure reducing pump 101, and when the pressure value reaches the upper limit value (5 kPa), the control portion moves on to Step S6 and stops the driving of the pressure reducing pump 101. Thereafter, the control portion moves on to Step S2 and monitors whether or not the pressure value (the vacuum level in the deaerator 102) detected by the pressure sensor 1101 is lower than the lower limit value (25 kPa). Then, the control portion repeats Steps S2 to S6 when the ink filling operation is being executed. When the pressure value (the vacuum level in the deaerator 102) detected by the pressure sensor 1101 does not reach the upper limit value (5 kPa) yet in Step S5, the control portion returns to Step S5 again while the control portion drives the pressure reducing pump 101.

Under the first setting conditions illustrated in FIG. 6, since the vacuum level in the deaerator 102 when the ink filling operation, the head cleaning operation, or the recording operation is executed is adjusted to be in a range of the upper limit value (an absolute value of 5 kPa) at which the capability maximum value of the pressure reducing pump 101 is reached to a lower limit value (an absolute value of 25 kPa) that is lower than the lower limit value (an absolute value of 75 kPa) of the vacuum level with which ejection stability of the ejection head can be maintained such that the amount of oxygen dissolved in the ink is 3 ppm to 10 ppm, it is possible to reduce air remaining in the ink flow path and the ejection head and unstable ejection from the ejection head. In addition, since the vacuum level in the deaerator 102 in the standby state is adjusted between the upper limit value (an absolute value of 65 kPa) that is lower than the capability maximum value of the pressure reducing pump 101 and the lower limit value (an absolute value of 75 kPa) of the vacuum level with which the ejection stability of the head can be maintained such that the amount of oxygen dissolved in the ink is 16 ppm to 20 ppm, it is possible to reduce precipitation of foreign matters in the ink, to reduce air remaining in the deaerator, the ink flow path, and the ejection head, and to reduce unstable ejection from the ejection head as compared with a case in which the vacuum level in the deaerator is maintained at a high level without being adjusted as in the related art. Since the vacuum level in the deaerator is adjusted to be higher when the air in the ejection head is replaced with the ink than when the ejection head is in a standby state in which the ink is not ejected, it is possible to curb generation of foreign matters from the ink due to continuation of the state in which the concentration of oxygen dissolved in the ink is low and to thereby reduce operation failures of the feeding pump and unstable ejection from the head.

When the pressure sensor 1101 is a relative pressure meter, it is preferable to adjust the vacuum level in the deaerator 102 as follows.

For example, an operator is allowed to input an atmospheric pressure at an installation location of the printer 1 from an input panel (not illustrate) of the computer 130 or the printer 1, a value obtained by subtracting the input atmospheric pressure (101 kPa, for example) from a vacuum level (an absolute pressure of 25 kPa, for example) to be adjusted is defined as a vacuum level (a relative pressure of −76 kPa in this case) to be adjusted, and driving control of the pressure reducing pump 101 is performed such that the relative pressure detected by the pressure sensor 1101 becomes the vacuum level (relative pressure) to be adjusted.

Alternatively, an achievable absolute pressure (5 kPa, for example) when the pressure in the deaerator 102 is reduced with the maximum capability of the pressure reducing pump 101 is grasped in advance, a relative pressure detected by the pressure sensor 1101 when the pressure in the deaerator 102 is reduced with the maximum capability of the pressure reducing pump 101 is defined as a maximum achievable relative pressure (−90 kPa in this case) in a case in which the atmospheric pressure is, for example, 95 kPa at the installation location of the printer 1, a value obtained by adding a difference (20 kPa) between the vacuum level (an absolute pressure of 25 kPa, for example) to be adjusted and the achievable absolute pressure (5 kPa) to the maximum achievable relative pressure (−90 kPa) is defined as a vacuum level (a relative pressure of −70 kPa in this case) to be adjusted, and the driving control of the pressure reducing pump 101 is thus performed such that the relative pressure detected by the pressure sensor 1101 becomes the vacuum level (relative pressure) to be adjusted.

Other Modification Examples

The embodiment can be implemented in modified manners as described below. The embodiment and the following examples can be implemented in combination as long as no technical conflicts occur.

In the adjustment of the vacuum level in the deaerator described above on the basis of FIG. 5, the second setting conditions illustrated in FIG. 7 may be employed as (setting of the upper limit value and the lower limit value of the vacuum level) used in Step S1. In this case, since the vacuum level in the deaerator 102 when the ink filling operation or the cleaning operation is executed is adjusted to be in a range of the upper limit value (an absolute value of 5 kPa) with which the capability maximum value of the pressure reducing pump 101 is reached to the lower limit value (an absolute value of 25 kPa) that is lower than the lower limit value (an absolute value of 75 kPa) of the vacuum level with which ejection stability of the head can be maintained such that the amount of oxygen dissolved in the ink is 3 ppm to 10 ppm, it is possible to reduce air remaining in the ink flow path and the head and unstable ejection from the head. In addition, the vacuum level in the deaerator 102 when the recording operation is executed is adjusted between the upper limit value (an absolute value of 26 kPa) that is lower than the lower limit value of the vacuum level with which the ink filling operation or the cleaning operation is executed and the lower limit value (an absolute value of 75 kPa) of the vacuum level with which ejection stability of the ejection head can be maintained such that the amount of oxygen dissolved in the ink is 11 ppm to 20 ppm, and the vacuum level in the deaerator 102 in the standby state is adjusted between the upper limit value (an absolute value of 65 kPa) that is lower than the upper limit value of the vacuum level during the recording operation and the lower limit value (an absolute value of 75 kPa) of the vacuum level with which ejection stability of the ejection head can be maintained such that the amount of oxygen dissolved in the ink is 16 ppm to 20 ppm, it is possible to curb generation of foreign matters from the ink due to continuation of a state in which the concentration of oxygen dissolved in the ink is low and to reduce operation failures of the feeding pump and unstable ejection from the head.

In the adjustment of the vacuum level in the deaerator described above on the basis of FIG. 5, the third setting conditions illustrated in FIG. 8 may be employed as (setting of the upper limit value and the lower limit value of the vacuum level) used in Step S1. In this case, since the vacuum level in the deaerator 102 when the ink filling operation or the cleaning operation is executed is adjusted to be in a range of the upper limit value (an absolute value of 5 kPa) with which the capability maximum value of the pressure reducing pump 101 is reached to the lower limit value (an absolute value of 25 kPa) that is lower than the lower limit value (an absolute value of 75 kPa) of the vacuum level with which ejection stability of the head can be maintained such that the amount of oxygen dissolved in the ink is 3 ppm to 10 ppm, it is possible to reduce air remaining in the ink flow path and the head and unstable ejection from the head. In addition, since the vacuum level in the deaerator 102 when the recording operation is executed is adjusted between the upper limit value (an absolute value of 15 kPa) between the upper limit value and the lower limit value of the vacuum level when the ink filling operation or the cleaning operation is executed and the lower limit value (an absolute value of 75 kPa) of the vacuum level with which ejection stability of the ejection head can be maintained such that the amount of oxygen dissolved in the ink is 6 ppm to 20 ppm, and the vacuum level in the deaerator 102 in the standby-state is adjusted between the upper limit value (an absolute value of 65 kPa) between the upper limit value and the lower limit value of the vacuum level during the recording operation and the lower limit value (an absolute value of 75 kPa) of the vacuum level with which ejection stability of the ejection head can be maintained such that the amount of oxygen dissolved in the ink is 16 ppm to 20 ppm, it is possible to curb generation of foreign matters from the ink due to continuation of a state in which the concentration of oxygen dissolved in the ink is low and to reduce operation failures of the feeding pump and unstable ejection from the head.

In the adjustment of the vacuum level in the deaerator described above on the basis of FIG. 5, the fourth setting conditions illustrated in FIG. 9 may be employed as (setting of the upper limit value and the lower limit value of the vacuum level) used in Step S1. In this case, since the vacuum level in the deaerator 102 when the ink filling operation is executed is adjusted to be in a range of the upper limit value (an absolute value of 5 kPa) with which the capability maximum value of the pressure reducing pump 101 is reached to the lower limit value (an absolute value of 25 kPa) that is lower than the lower limit value (an absolute value of 75 kPa) of the vacuum level with which ejection stability of the head can be maintained such that the amount of oxygen dissolved in the ink is 3 ppm to 10 ppm, it is possible to reduce air remaining in the ink flow path and the head and unstable ejection from the ejection head. In addition, since the vacuum level in the deaerator 102 when the cleaning operation or the recording operation is executed or when the ejection head is in the standby state is adjusted between the upper limit value (an absolute value of 26 kPa) that is lower than the upper limit value of the vacuum level when the ink filling operation is executed and the lower limit value (an absolute value of 75 kPa) of the vacuum level with which ejection stability of the ejection head can be maintained such that the amount of oxygen dissolved in the ink is 11 ppm to 20 ppm, it is possible to curb generation of foreign matters from the ink due to continuation of a state in which the concentration of oxygen dissolved in the ink is low and to reduce operation failures of the feeding pump and unstable ejection from the head.

As illustrated in FIG. 4, the relationship between the vacuum level (absolute pressure) in the deaerator and the amount of oxygen dissolved in the ink differs depending on the temperature of the ink. In this case, the upper limit value and the lower limit value of the vacuum level corresponding to the amount of oxygen dissolved in the ink may be corrected in accordance with the temperature of the ink adjusted by the warming device 90.

In a recording preparation state in which there is print data even in a standby state in which no ink is ejected from the ejection head 60, it is preferable to adjust the vacuum level such that the upper limit value and the lower limit value of the vacuum level in the deaerator 102 are set to be the same as those when an operation to be executed is a recording operation. When a formatting operation is executed immediately after the power state changes from the OFF state to the ON state even in the standby state in which no ink is ejected from the ejection head 60, the vacuum level may be adjusted such that the upper limit value and the lower limit value of the vacuum level in the deaerator 102 are set to be the same as those when an operation to be executed is an ink filling operation.

The damper unit 84 may be disposed at a position between the feeding pump 82 and the temperature adjustment module 94 in the ink flow path 51 or may be disposed at a position between the temperature adjustment module 94 and the deaerator 102. As the damper unit 84, an accumulator may be used.

The feeding pump may be a diaphragm pump including one pump chamber or a three-phase diaphragm pump including three pump chambers. The warming device 90 may not be provided.

The pressure reducing pump 101 may not be provided, and the pressure in the deaerator 102 may be reduced with an externally provided negative pressure generation device. In this case, the negative pressure generation device and the deaerator 102 may be coupled with an air flow path, an opening and closing valve that serves as a vacuum level adjustment mechanism may be provided in the air flow path, and the vacuum level in the deaerator 102 may be adjusted through opening and closing of the opening and closing valve.

The ink may not be an ultraviolet curable ink and may be a water-based pigment ink, for example. Also, supply of air bubbles as foreign matters to the ejection head 60 and air bubbles remaining in the ejection head 60 may be reduced by controlling the driving of the pressure reducing pump 101 such that the deaerator 102 reaches the vacuum level (absolute pressure) corresponding to the amount of nitrogen dissolved (the amount of air dissolved) to be adjusted on the basis of a relationship between the vacuum level (absolute pressure) in the deaerator 102 obtained in advance through experiments or the like and the amount of nitrogen dissolved in the ink (the amount of air dissolved).

Description of Evaluation Test

Although the embodiments of the present disclosure will be described below with reference to examples, the present disclosure is not limited to these examples.

Raw materials used in the following examples and comparative examples were as follows.

Coloring Material

- C.I. Pigment black 7 (MICROLITH BLACK C-K [product name] manufactured by BASF; abbreviated as a "black pigment" in the tables below)

Dispersant

- SOLSPERSE 36000 (name of product manufactured by Noveon) Polymerizable compound
- VEEA (acrylic acid 2-(2-vinyloxyethoxy)ethyl; a name of product manufactured by Nippon Shokubai Co., Ltd.)

PEA (phenoxyethyl acrylate; manufactured by Osaka Organic Chemical Industry Ltd.; product name: BIS-COAT #192)

DPGDA (dipropylene glycol diacrylate; manufactured by Sartomer; product name: SR508)

Hindered Amine Compound (Polymerization Inhibitor)

ADEKASTAB LA-82 (1,2,2,6,6-pentamethyl-4-piperidyl methacrylate; manufactured by ADEKA; product name; abbreviated as "LA-82" in the tables below)

ADEKASTAB LA-7RD (2,2,6,6-tetramethyl-4-hydroxypiperidine-1-oxyl; manufactured by ADEKA; product name; abbreviated as "LA-7RD" in the tables below)

TINUVIN144 (bis(1,2,2,6,6-pentamethyl-4-piperidyl) [[3,5-bis(1,1-dimethylethyl)-4-hydroxyphenyl]methyl] butylmalonate; manufactured by BASF; product name)

Polymerization Inhibitor

MEHQ (p-methoxyphenol; manufactured by Tokyo Chemical Industry Co., Ltd.)

Photopolymerization Initiator

Acylphosphine Oxide-Based Compound

IRGACURE 819 (manufactured by BASF; product name; solid content of 100%)

DAROCUR TPO (manufactured by BASF; product name; solid content of 100%)

Acetophenone-Based Compound

IRGACURE 369 (manufactured by BASF; product name; solid content of 100%)

Ink Jet Recording Device

An ink jet recording device obtained by modifying an ink jet printer Surepress L-4033A (manufactured by Seiko Epson Corporation) (hereinafter, referred to as a modified machine) was used. As illustrated in FIG. 2, modified points were that a supply pump, an ink circulation path, a feeding pump in the ink circulation path, a warming device, a deaeration device, and a filter unit were provided, that a light source was disposed on downstream of a line head in a recording target medium transport direction such that one-pass printing using ultraviolet curable ink was enabled, that a damper unit was added in accordance with an experiment specification, and that a specification of the feeding pump was changed in accordance with the experiment specification. Description will be given below.

As a diaphragm pump, NF60 (manufactured by KNF; product name: diaphragm pump) was used and was disposed at a position at the feeding pump 82 illustrated in FIG. 2.

As a gear pump, AK55F-S12C (manufactured by Assist; product name) was used, and the driving gear 46 illustrated in FIG. 3 was replaced with one formed by the material (polyphenylene sulfide (PPS) or ceramic (a mixture of silicon carbide and silicon nitride) in Tables 1 and 2 and was mounted at a position of the feeding pump 82 illustrated in FIG. 2.

A deaeration device provided with the deaerator 102 illustrated in FIG. 2 was used. The warming device was adapted to warm the ink in the ink circulation path with a temperature adjustment module while circulating warm water from a warm water tank between the temperature adjustment module and the warm water tank with a warm water circulation pump.

The amount of oxygen dissolved in the ink in the ink circulation path was adjusted as follows. As ink to be accommodated in a cartridge, each adjusted ink was prepared by adjusting a deaeration time of the pressure reducing pump and performing pressure reduction and deaeration thereon such that the amount of oxygen dissolved in each example in Tables 1 and 2 were achieved, and the prepared ink was accommodated in the cartridge. The ink circulation path 80 was filled with the ink from the cartridge in each example via the ink flow path 51 in FIG. 2. The flow rate of the ink in the feeding pump 82 was set to 210 g/minute. The temperature adjustment module 94 was operated to warm the ink. The deaerator 102 was operated to perform deaeration on the ink so as to offset a natural increase in the amount of oxygen dissolved in the ink and stabilize the amount of oxygen. Thus, the ink was circulated for 30 minutes so as to stabilize the temperature of the ink and the amount of oxygen dissolved therein. The temperature of the ink was 40° C. in each example, and the amount of oxygen dissolved was the value in each example in Tables 1 and 2. For the temperature of the ink, the temperature of the nozzle surface of the head was measured and defined as an ink temperature. The amount of oxygen dissolved in the ink was measured by collecting ink from the ink circulation path 80 immediately before flowing into the feeding pump 82.

Examples 1 to 13 and Comparative Examples 1 to 9

Production of Ultraviolet Curable Ink Jet Recording Ink

The constituents described in Tables 1 and 2 were added to meet the compositions (the units were % by mass) described in Tables 1 and 2, and the mixtures were stirred with a stirrer, thereby preparing ultraviolet curable ink jet recording ink.

Measurement of Amount of Oxygen Dissolved

The amount of oxygen dissolved in the ink collected from the ink circulation path 80 immediately before flowing into the feeding pump 82 was measured using a gas chromatography Agilent 6890 (manufactured by Agilent Technologies), and it was confirmed that the amount of oxygen dissolved was each value in Tables 1 and 2. As carrier gas, helium (He) gas was used. For the amount of oxygen dissolved in the ink, a volume of oxygen (gas) dissolved in the ink (liquid) with a predetermined volume was represented in units of ppm.

TABLE 1

| | Example 1 | Example 2 | Example 3 | Example 4 | Example 5 | Example 6 | Example 7 | Example 8 | Example 9 | Example 10 | Example 11 | Example 12 | Example 13 |
|---|---|---|---|---|---|---|---|---|---|---|---|---|---|
| C.I. Pigment black 7 | — | — | — | — | — | 2.0 | 2.0 | 2.0 | 2.0 | 2.0 | 2.0 | 2.0 | 2.0 |
| Solsperse36000 | — | — | — | — | — | 1.0 | 1.0 | 1.0 | 1.0 | 1.0 | 1.0 | 1.0 | 1.0 |
| VEEA | 30.0 | 30.0 | 30.0 | 30.0 | 30.0 | 30.0 | 30.0 | 30.0 | 30.0 | 30.0 | 30.0 | 30.0 | 30.0 |
| PEA | 20.0 | 20.0 | 20.0 | 20.0 | 20.0 | 20.0 | 20.0 | 20.0 | 20.0 | 20.0 | 20.0 | 20.0 | 20.0 |
| DPGDA | 37.8 | 37.8 | 37.8 | 37.4 | 37.9 | 34.8 | 34.8 | 34.8 | 34.8 | 34.8 | 34.8 | 34.9 | 34.9 |
| TINUVIN144 | — | 0.1 | — | — | — | — | — | — | — | — | — | — | — |
| LA-82 | — | — | 0.1 | — | — | — | — | — | — | — | — | — | — |
| LA-7RD | 0.1 | — | — | 0.5 | 0.05 | 0.1 | 0.1 | 0.1 | 0.1 | 0.1 | 0.1 | 0.1 | 0.1 |

TABLE 1-continued

| | Example 1 | Example 2 | Example 3 | Example 4 | Example 5 | Example 6 | Example 7 | Example 8 | Example 9 | Example 10 | Example 11 | Example 12 | Example 13 |
|---|---|---|---|---|---|---|---|---|---|---|---|---|---|
| MEHQ | 0.1 | 0.1 | 0.1 | 0.1 | 0.1 | 0.1 | 0.1 | 0.1 | 0.1 | 0.1 | 0.1 | — | — |
| IRGACURE 819 | 5.0 | 5.0 | 5.0 | 5.0 | 5.0 | 5.0 | 5.0 | 5.0 | 5.0 | 5.0 | 5.0 | 5.0 | 5.0 |
| DAROCUR TPO | 5.0 | 5.0 | 5.0 | 5.0 | 5.0 | 5.0 | 5.0 | 5.0 | 5.0 | 5.0 | 5.0 | 5.0 | 5.0 |
| IRGACURE 369 | 2.0 | 2.0 | 2.0 | 2.0 | 2.0 | 2.0 | 2.0 | 2.0 | 2.0 | 2.0 | 2.0 | 2.0 | 2.0 |
| Amount of oxygen dissolved (ppm) | 10 | 10 | 10 | 10 | 10 | 10 | 10 | 20 | 5 | 2 | 1 | 10 | 20 |
| Feeding pump | Gear | Gear | Gear | Gear | Gear | Gear | Gear | Gear | Gear | Gear | Gear | Diaphragm | Diaphragm |
| Gear material | PPS | PPS | PPS | PPS | PPS | PPS | Ceramic | PPS | PPS | PPS | PPS | — | — |
| Damper unit | None | None | None | None | None | None | None | None | None | None | None | Provided | Provided |
| Durability | A | B | B | A | B | A | A | A | A | A | B | A | A |
| Ejection stability | A | A | A | A | A | A | A | A | A | A | A | A | A |
| Curability | A | A | A | A | A | A | A | A | A | A | A | A | A |
| Ejection amount stability test | A | A | A | A | A | A | A | A | A | A | A | A | A |

TABLE 2

| | Comparative Example 1 | Comparative Example 2 | Comparative Example 3 | Comparative Example 4 | Comparative Example 5 | Comparative Example 6 | Comparative Example 7 | Comparative Example 8 | Comparative Example 9 |
|---|---|---|---|---|---|---|---|---|---|
| C.I. Pigment black 7 | 2.0 | 2.0 | — | 2.0 | — | 2.0 | 2.0 | 2.0 | 2.0 |
| Solsperse36000 | 1.0 | 1.0 | — | 1.0 | — | 1.0 | 1.0 | 1.0 | 1.0 |
| VEEA | 30.0 | 30.0 | 30.0 | 30.0 | 30.0 | 30.0 | 30.0 | 30.0 | 30.0 |
| PEA | 20.0 | 20.0 | 20.0 | 20.0 | 20.0 | 20.0 | 20.0 | 20.0 | 20.0 |
| DPGDA | 34.8 | 34.8 | 37.9 | 34.9 | 37.9 | 35.0 | 34.9 | 34.9 | 34.9 |
| TINUVIN144 | — | — | — | — | — | — | — | — | — |
| LA-82 | — | — | — | — | — | — | — | — | — |
| LA-7RD | 0.1 | 0.1 | — | 0.1 | — | — | 0.1 | 0.1 | 0.1 |
| MEHQ | 0.1 | 0.1 | 0.1 | — | 0.1 | — | — | — | — |
| IRGACURE 819 | 5.0 | 3.0 | 5.0 | 5.0 | 5.0 | 5.0 | 5.0 | 5.0 | 5.0 |
| DAROCUR TPO | 5.0 | 3.0 | 5.0 | 5.0 | 5.0 | 5.0 | 5.0 | 5.0 | 5.0 |
| IRGACURE 369 | 2.0 | 6.0 | 2.0 | 2.0 | 2.0 | 2.0 | 2.0 | 2.0 | 2.0 |
| Amount of oxygen dissolved (ppm) | 30 | 30 | 30 | 30 | 10 | 20 | 10 | 20 | 30 |
| Feeding pump | Gear | Gear | Gear | Diaphragm | Gear | Diaphragm | Diaphragm | Diaphragm | Diaphragm |
| Gear material | PPS | PPS | PPS | — | PPS | — | — | — | — |
| Damper unit | None | None | None | Provided | None | Provided | None | None | None |
| Durability | A | A | C | A | D | C | A | A | A |
| Ejection stability | B | A | A | B | A | A | A | A | A |
| Curability | A | B | A | A | A | A | A | A | A |
| Ejection amount stability test | A | A | A | A | A | A | B | B | B |

Durability Test

The ink in each of the examples and the comparative examples was fed using a modified machine at an ink flow rate of 210 g/minute. A time before the gear was locked and it became impossible to distribute the ink was measured for the gear pump, a time before the diaphragm was broken and it became impossible to distribute the ink was measured for the diaphragm pump, and durability was evaluated using the following evaluation criteria. When the locked gear pump was disassembled and observed, viscous substances that were considered to be derived from the ink adhered to the surroundings of the gear. Also, heat generation at the gear engagement portion was observed during the distribution.

Evaluation Criteria

A: The time was longer than 2000 hours.

B: The time was longer than 500 hours and equal to or less than 2000 hours.

C: The time was longer than 24 hours and equal to or less than 500 hours.

D: The time was equal to or less than 24 hours.

Ejection Stability Test

The modified machine was used to cause one head (600 nozzles) to successively eject the ink composition in each of the examples and the comparative examples at an ejection frequency of 10 kHz. Whether or not there was any of the non-ejecting nozzles was inspected every time 1-minute ejection was performed, and a cumulative time of the ejection times until the point at which the non-ejecting nozzles were discovered was measured as a time during which successive ejection was able to be performed. Ejection stability was evaluated on the basis of the time using the following evaluation criteria.

Evaluation Criteria

A: The time was longer than 60 minutes.

B: The time was longer than 20 minutes and equal to or less than 60 minutes.

C: The time was longer than 10 minutes and equal to or less than 20 minutes.

D: The time was longer than 0 minutes and equal to or less than 10 minutes.

Ejection Amount Stability Test

The modified machine was used to cause one nozzle to successively eject the ink in each of the examples and the comparative examples onto a recording target medium (PET T50A PL SIN LINTEC) for 10 minutes while transporting the recording target medium, the ink was irradiated with ultraviolet rays from a light source (LED) disposed on downstream of the head in the transport direction to cure the ink adhering to the recording target medium, thereby forming dots. The dot diameters of the formed dot array were measured, and a ratio of a difference between a maximum dot diameter and a minimum dot diameter with respect to an average dot diameter was calculated. Ejection amount stability was evaluated on the basis of the ratio using the following evaluation criteria.

Evaluation Criteria

A: The ratio was equal to or less than 5%.

B: The ratio was greater than 5%.

In Comparative Examples 7, 8, and 9 in which the diaphragm pump was used (no damper unit), ejection amount stability was poor due to influences of pulsation, and dots with large dot diameters and dots with small dot diameters periodically appeared. For the other pumps including the diaphragm pumps used in Examples 12 and 13 (with the damper unit) and Comparative Example 4 (with the damper unit), differences in dot diameters were small, and periodic changes were not observed.

Curability Test

A bar coater was used to apply the ink in each of the examples and the comparative examples to a PET film (PET50A PL SIN [product name] manufactured by Lintec) and an ink coated film was produced such that the thickness after curing was 10 μm. Thereafter, the coated film was irradiated with an ultraviolet ray with irradiation intensity of 1,100 mW/cm$^2$ and a wavelength of 395 nm to cure the coated film. The cured coated film (cured film) was rubbed with 10 times with a weight of 100 g using a cotton swab, and curing energy (irradiation energy) at a timing no scratching was generated was obtained.

The irradiation intensity [mW/cm$^2$] on an irradiation target surface irradiated from the light source was measured, and the irradiation energy [mJ/cm$^2$] was obtained from a product of the irradiation intensity and an irradiation continuation time [s]. The irradiation intensity was measured using an ultraviolet intensity meter UM-10 and a receiving unit UM-400 (both were manufactured by Konica Minolta Sensing, Inc.). Curability was evaluated using the following evaluation criteria.

Evaluation Criteria

A: The irradiation energy was equal to or less than 200 mJ/cm.

B: The irradiation energy was greater than 200 mJ/cm$^2$.

In comparison between Comparative Examples 1 and 2, while the ink composition containing the acylphosphine oxide-based initiator had excellent ink composition curability, it was inferred that the acylphosphine oxide-based initiator served as air bubble cores, induced generation of air bubbles, degraded ejection stability, and led to a trend that ejection stability was degraded when the amount of oxygen dissolved was large. Therefore, it was necessary to reduce the amount of oxygen dissolved in order to improve the ejection stability, and it was discovered that the present disclosure is particularly useful in that case.

In comparison between Comparative Examples 1 and 3, it was inferred that when the ink contains a pigment, the pigment served as air bubble cores, induced generation of air bubbles, and degraded ejection stability when the amount of oxygen dissolved was large in some cases. When the ink contained the pigment to be used for coloring, it was necessary to reduce the amount of oxygen dissolved in order to improve ejection stability, and it was discovered that the present disclosure was particularly useful in that case.

As described above, it was discovered that the ultraviolet curable ink jet recording device according to the present disclosure exhibited excellent durability and ejection amount stability and further excellent curability and ejection stability. Meanwhile, in Comparative Examples 3, 5, and 6, the ink stuck to the inside of the feeding pump and lead to poor durability since no hindered amine compound was contained. In Comparative Examples 7 to 9, the diaphragm pump was used in a state in which no damper unit was provided, poor ejection amount stability was achieved, and dots with large dot diameters and small dot diameters periodically appeared due to influences of pulsation.

Also, the ink used in the present disclosure exhibited that it was able to improve durability of the ultraviolet curable ink jet recording device by containing the hindered amine compound. Further, the fact that it was possible to further improve durability of the ultraviolet curable ink jet recording device by containing 0.05 to 0.5% by mass of hindered amine compound or by the hindered amine compound containing the compound having a 2,2,6,6-tetramethylpiperidine-N-oxyl skeleton.

It was observed that, when at least either polyphenylene sulfide or ceramic was contained as a material for gears of the gear pump, excellent durability, in particular, was achieved while the fact that swelling of these materials when the materials came into contact with the ink used in the embodiment was smaller than that of the other materials, and it was inferred that no contact between the gears occurred due to the swelling.

Further, when the evaluation that was similar to that in Comparative Example 2 was conducted other than that 10% by mass of pentaerythritol tetraacrylate (manufactured by Shin-Nakamura Chemical Co., Ltd.) and 24.8% by mass of DPGDA were used instead of 34.8% by mass of DPGDA in the ink in Comparative Example 2, the result of evaluating durability was B, the result of evaluating ejection stability was A, the result of evaluating curability was A, and the result of evaluating ejection amount stability was A. When the ink contains trifunctional or higher functional (meth) acrylate, further excellent ink curability was achieved while there was a trend that durability was degraded, and it was discovered that the present disclosure was particularly useful.

Further, when the evaluation that was similar to that in Example 1 was conducted other than that the ink flow rate of the gear pump was changed to 40 g/minute, the trend that the temperature of the ink and the amount of oxygen dissolved were not stabilized was observed. When the evaluation that was similar to that in Example 1 was conducted other than that the ink flow rate of the gear pump was changed to 500 g/minute, the result of evaluating durability was degraded to B.

Hereinafter, technical ideas and effects and advantages thereof that are recognized from the aforementioned embodiment and the modification examples will be described.

The recording device includes: an ejection head configured to perform recording by ejecting ink onto a recording medium; an ink flow path that couples a liquid reservoir to the ejection head such that the ink stored in the liquid reservoir is supplied to the ejection head; a feeding pump exchangeably provided in the ink flow path and configured to feed the ink toward the ejection head; a deaerator provided in the ink flow path; a vacuum level adjustment mechanism configured to adjust a vacuum level in the deaerator; and a control portion that controls the vacuum level adjustment mechanism to adjust the vacuum level in the deaerator in accordance with a status of an operation to be executed.

With this configuration, it is possible to adjust the vacuum level to be low depending on the status of the operation, thereby to curb generation of foreign matters from the ink due to the amount of gas dissolved in the ink, and to reduce unstable ejection from the ejection head as compared with a case in which the deaerator maintained in a high vacuum level state is used.

In the recording device, the control portion may adjust the vacuum level in the deaerator such that the vacuum level when the ejection head is filled with the ink is higher than the vacuum level when the election head is in a standby state in which the ink is not ejected.

With this configuration, since the vacuum level in the deaerator when the air in the ink flow path and the ejection head is replaced with the ink is adjusted to be higher than that of the case in which the ejection head is in a standby state in which the ink is not ejected, it is possible to reduce unstable ejection from the ejection head after the ink filling operation due to the air remaining in the ink flow path and the ejection head.

In the recording device, the control portion may adjust the vacuum level in the deaerator such that an upper limit value (on a higher vacuum level side) of the vacuum level when the ejection head is in a standby state in which the ink is not ejected is lower than an upper limit value (on a higher vacuum level side) of the vacuum level when the ejection head performs recording on the recording medium.

With this configuration, since the lower limit value of the vacuum level in the deaerator when no ejection was performed by the ejection head is adjusted to be lower than that in a case in which recording is performed on the recording medium, it is possible to curb generation of foreign matters from the ink and to reduce unstable ejection from the ejection head.

The recording device may further include: an ink circulation path that couples the ejection head to the liquid reservoir such that the ink supplied to the ejection head is returned to the liquid reservoir; and a filter unit exchangeably provided in the ink flow path, in which the deaerator may be provided at a position between the feeding pump and the ejection head, and the filter unit may be provided at a position between the deaerator and the ejection head, in the ink flow path.

With this configuration, it is possible to supply the ink with the amount of dissolved oxygen adjusted by the deaerator to the ejection head and to reduce supply of foreign matters generated from the ink and air to the ejection head. Further, when the ink is ultraviolet curable ink and the feeding pump is a gear pump, the amount of oxygen dissolved in the ink at the position of the gear pump is larger than the amount of oxygen dissolved in the ink at the position of the ejection head, it is thus possible to employ this arrangement to enable reduction in operation failures of the feeding pump.

In the recording device, the feeding pump may be a displacement pump that configures a part of the ink flow path and feeds the ink by changing a volume in a pump chamber, at least a part of which is formed of a flexible member, and a damper unit that configures a part of the ink flow path and has a wall, a part of which is formed of a flexible film, may be provided at a position between the feeding pump and the ejection head in the ink flow path.

With this configuration, the feeding pump does not have a shaft sliding portion as in the gear pump, it is possible to reduce operation failures of the feeding pump even when the ink is ultraviolet curable ink.

In the recording device, the ink may be ultraviolet curable ink containing a polymerization inhibitor, and the control portion may adjust the vacuum level in the deaerator such that an amount of oxygen dissolved in the ultraviolet curable ink when the ejection head is filled with the ink is equal to or less than 10 ppm and may adjust the vacuum level in the deaerator such that the amount of oxygen dissolved in the ultraviolet curable ink when recording is performed on the recording medium is greater than 10 ppm and equal to or less than 20 ppm.

With this configuration, it is possible to suitably employ the present disclosure as a method of adjusting the vacuum level in the deaerator when the ink is ultraviolet curable ink.

The maintenance method for the recording device that includes an ejection head configured to perform recording by ejecting ink onto a recording medium, an ink flow path coupled to the ejection head such that the ink is supplied to the ejection head, a feeding pump exchangeably provided in the ink flow path and configured to cause the ink to flow toward the ejection head; and a deaerator provided in the ink flow path, the method includes performing adjustment such that a vacuum level in the deaerator when the ejection head is filled with the ink is higher than the vacuum level in the deaerator when the ejection head is in a standby state in which the ink is not ejected.

According to this method, since the vacuum level in the deaerator when the air in the ink flow path and the ejection head is replaced with the ink is adjusted to be higher than that when the ejection head is in a standby state in which the ink is not ejected, it is possible to reduce the air remaining in the ink flow path and the ejection head and unstable ejection from the ejection head after the ink filling operation.

What is claimed is:

1. A recording device comprising:

an ejection head configured to perform recording by ejecting ink onto a recording medium;

an ink flow path that couples a liquid reservoir to the ejection head such that the ink stored in the liquid reservoir is supplied to the ejection head;

a feeding pump provided in the ink flow path and configured to feed the ink toward the ejection head;

a deaerator provided in the ink flow path;

a vacuum level adjustment mechanism configured to adjust a vacuum level in the deaerator; and a control portion that controls the vacuum level adjustment mechanism to adjust the vacuum level in the deaerator in accordance with a status of an operation to be executed, wherein when a filling operation is performed to fill the ejection head with ink, the recording device is in a first status, and the control portion adjusts the vacuum level in the deaerator to a first predetermined level, and wherein when the recording device is in a standby state, in which the ink is not ejected from the ejection head, the recording device is in a second status, and the control portion adjusts the vacuum level in the deaerator to a second predetermined level that is lower than the first predetermined level.

2. The recording device according to claim 1, wherein the control portion adjusts the vacuum level in the deaerator such that an upper limit value of the vacuum level when the standby state is lower than an upper limit value of the vacuum level when the ejection head performs recording on the recording medium.

3. The recording device according to claim 1, further comprising:

an ink circulation path that couples the ejection head to the liquid reservoir such that the ink supplied to the ejection head is returned to the liquid reservoir; and a filter unit exchangeably provided in the ink flow path, wherein the deaerator is provided at a position between the feeding pump and the ejection head, and the filter unit is provided at a position between the deaerator and the ejection head, in the ink flow path.

4. The recording device according to claim 1, wherein the feeding pump is a displacement pump that configures a part of the ink flow path and feeds the ink by changing a volume in a pump chamber, at least a part of which is formed of a flexible member, and a damper unit that configures a part of the ink flow path and has a wall, a part of which is formed of a flexible film, is provided at a position between the feeding pump and the ejection head in the ink flow path.

5. The recording device according to claim 1, wherein the ink is ultraviolet curable ink containing a polymerization inhibitor, and the control portion adjusts the vacuum level in the deaerator such that an amount of oxygen dissolved in the ultraviolet curable ink when the ejection head is filled with the ink is equal to or less than 10 ppm and adjusts the vacuum level in the deaerator such that the amount of oxygen dissolved in the ultraviolet curable ink when recording is performed on the recording medium is greater than 10 ppm and equal to or less than 20 ppm.

6. The recording device according to claim 1, wherein the feeding pump exchangeably provided in the ink flow path.

7. The recording device according to claim 1, wherein the control portion adjusts the vacuum level in the deaerator to the second predetermined level when the recording device is running.

8. A maintenance method for a recording device that includes an ejection head configured to perform recording by ejecting ink onto a recording medium, an ink flow path coupled to the ejection head such that the ink is supplied to the ejection head, a feeding pump provided in the ink flow path and configured to cause the ink to flow toward the ejection head, and a deaerator provided in the ink flow path, the method comprising:

performing adjustment of a vacuum level at a filling operation to fill the head with ink to a first level; and performing adjustment of a vacuum level at a standby state in which the ink is not ejected from the ejection head to a second level that is lower than the first level.

9. The maintenance method for a recording device according to claim 8, wherein the vacuum level in the deaerator is adjusted such that an upper limit value of the vacuum level when the standby state in which the ink is not ejected is lower than an upper limit value of the vacuum level when the ejection head performs recording on the recording medium.

10. The maintenance method for a recording device according to claim 8, wherein the ink is ultraviolet curable ink containing a polymerization inhibitor, the vacuum level in the deaerator is adjusted such that an amount of oxygen dissolved in the ultraviolet curable ink when the ejection head is filled with the ink is equal to or less than 10 ppm, and the vacuum level in the deaerator is adjusted such that the amount of oxygen dissolved in the ultraviolet curable ink when recording is performed on the recording medium is greater than 10 ppm and equal to or less than 20 ppm.

11. The maintenance method for a recording device according to claim 8, wherein performing adjustment of the vacuum level to a second level when the recording device is running.

12. A recording device comprising:

an ejection head configured to perform recording by ejecting ink onto a recording medium;

an ink flow path that couples a liquid reservoir to the ejection head such that the ink stored in the liquid reservoir is supplied to the ejection head;

a feeding pump provided in the ink flow path and configured to feed the ink toward the ejection head;

a deaerator provided in the ink flow path;

a vacuum level adjustment mechanism configured to adjust a vacuum level in the deaerator; and a control portion that controls the vacuum level adjustment mechanism to adjust the vacuum level in the deaerator in accordance with each of a plurality of statuses of the recording device, wherein:

when a filling operation is performed to fill the ejection head with the ink, the recording device is in a first status, and the control portion controls the vacuum level adjustment mechanism to adjust the vacuum level in the deaerator to a first level, and when the ejection head is in a standby state, in which the ink is not ejected from the ejection head, the recording device is in a second status, and the control portion controls the vacuum level adjustment mechanism to adjust the vacuum level in the deaerator to a second level that is lower than the first level.

13. The recording device according to claim 12, wherein the control portion adjusts the vacuum level in the deaerator to a second predetermined level when the recording device is running.

* * * * *